US008197041B2

(12) United States Patent
Morino

(10) Patent No.: US 8,197,041 B2
(45) Date of Patent: Jun. 12, 2012

(54) IMAGE FORMING APPARATUS USING LIQUID FOR FORMING IMAGES

(75) Inventor: Tetsu Morino, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 357 days.

(21) Appl. No.: 12/509,571

(22) Filed: Jul. 27, 2009

(65) Prior Publication Data

US 2010/0026742 A1 Feb. 4, 2010

(30) Foreign Application Priority Data

Jul. 29, 2008 (JP) ..... 2008-194296
Jan. 26, 2009 (JP) ..... 2009-014699

(51) Int. Cl.
*B41J 2/18* (2006.01)

(52) U.S. Cl. ..... 347/85; 347/19

(58) Field of Classification Search ..... 347/85, 347/19

See application file for complete search history.

(56) References Cited

U.S. PATENT DOCUMENTS

| | | | | |
|---|---|---|---|---|
| 4,636,814 | A * | 1/1987 | Terasawa | 347/86 |
| 5,757,390 | A * | 5/1998 | Gragg et al. | 347/7 |
| 5,886,718 | A * | 3/1999 | Johnson et al. | 347/85 |
| 2002/0024543 | A1* | 2/2002 | Kimura et al. | 347/7 |
| 2004/0179056 | A1* | 9/2004 | Katayama | 347/19 |
| 2005/0194730 | A1 | 9/2005 | Nishida et al. | |
| 2007/0046741 | A1* | 3/2007 | Umeda | 347/85 |
| 2007/0109362 | A1* | 5/2007 | Hori et al. | 347/65 |
| 2008/0007600 | A1* | 1/2008 | Scardovi et al. | 347/85 |
| 2008/0049084 | A1* | 2/2008 | Katada | 347/92 |
| 2008/0225066 | A1 | 9/2008 | Yorimoto et al. | |
| 2008/0225067 | A1 | 9/2008 | Morino et al. | |
| 2008/0225068 | A1 | 9/2008 | Morino et al. | |
| 2008/0225098 | A1 | 9/2008 | Hagiwara et al. | |
| 2008/0231649 | A1 | 9/2008 | Kawabata et al. | |
| 2009/0015621 | A1 | 1/2009 | Hirota et al. | |

FOREIGN PATENT DOCUMENTS

| | | |
|---|---|---|
| JP | 2007-105935 | 4/2007 |
| JP | 2007-223230 | 9/2007 |
| JP | 2008-49672 | 3/2008 |

* cited by examiner

*Primary Examiner* — Charlie Peng
*Assistant Examiner* — Peter Radkowski
(74) *Attorney, Agent, or Firm* — Cooper & Dunham LLP

(57) ABSTRACT

An image forming apparatus includes a recording head, a sub-tank, a main tank, a supply unit, a memory, and a controller. The sub-tank includes an ink storage container, a flexible member, an elastic member, and an atmosphere-communicable unit. The ink storage container has an opening sealed by the flexible member biased by the elastic member. The main tank stores ink to be supplied to the sub-tank. The controller controls an ink dispensing operation depending on image forming conditions. The controller determines whether a gas bubble intrudes in the sub-tank. The controller executes the ink dispensing operation from the recording head using a dispensable ink volume when an ink supply from the main tank to the sub-tank is unable to be continued. The controller variably sets the dispensable ink volume. The controller determines that an ink end condition occurs when the recording head dispenses the dispensable ink volume from the sub-tank.

16 Claims, 17 Drawing Sheets

FIG. 12A

| SEQUENCE | CONDITION OR ACTION | CARTRIDGE INK END FLAG | INK END FLAG | FLAGS FOR AIR INTRUSION | | DISPENSABLE INK VOLUME OF SUB-TANK |
|---|---|---|---|---|---|---|
| | | | | AIR INTRUSION FLAG | AIR INTRUSION HISTORY FLAG | |
| 1 | | 0 | 0 | 1 | X | NORMAL VOLUME |
| | (IMAGE FORMING OPERATION) | | | | | |
| 2 | CARTRIDGE INK END CONDITION OCCURS | 0 → 1 | 0 | 1 → 1 | X → 1 | 1ST VOLUME |
| | (IMAGE FORMING OPERATION USING INK IN SUB-TANK) | | | | | |
| 3 | SUB-TANK CONSUMES DISPENSABLE INK VOLUME (INK END) | 1 | 0 → 1 | 1 | 1 | 1ST VOLUME |
| 4 | REPLACEMENT OF INK CARTRIDGE | 1 → 0 | 1 → 0 | 1 | 1 | 1ST VOLUME → NORMAL VOLUME |
| | (GIVEN TIME (e.g., 24 HOURS) ELAPSES) | | | | | |
| 5 | RESET AIR INTRUSION FLAG | 0 | 0 | 1 → 0 | 1 → 0 | |

X = 1, 0
1ST VOLUME : 1ST DISPENSABLE INK VOLUME
NORMAL VOLUME : NORMAL DISPENSABLE INK VOLUME

1ST VOL : 1ST DISPENSABLE INK VOLUME
2ND VOL : 2ND DISPENSABLE INK VOLUME
NOR. VOL : NORMAL DISPENSABLE INK VOLUME

V0 : NORMAL DISPENSABLE INK VOLUME
V1 : 1ST DISPENSABLE INK VOLUME
V2 : 2ND DISPENSABLE INK VOLUME

FIG. 14A

| SEQUENCE | CONDITION OR ACTION | CARTRIDGE INK END FLAG | INK END FLAG | FLAGS FOR AIR INTRUSION | | DISPENSABLE INK VOLUME OF SUB-TANK |
|---|---|---|---|---|---|---|
| | | | | AIR INTRUSION FLAG | AIR INTRUSION HISTORY FLAG | |
| 1 | | 0 | 0 | 0 | X | NORMAL VOLUME |
| | (IMAGE FORMING OPERATION) | | | | | |
| 2 | CARTRIDGE INK END CONDITION OCCURS | 0 → 1 | 0 | 1 → 1 | X → 0 | 2ND VOLUME |
| | (IMAGE FORMING OPERATION USING INK IN SUB-TANK) | | | | | |
| 3 | SUB-TANK CONSUMES DISPENSABLE INK VOLUME (INK END) | 1 | 0 → 1 | 1 | 0 | 2ND VOLUME |
| 4 | REPLACEMENT OF INK CARTRIDGE | 1 → 0 | 1 → 0 | 1 | 0 | 2ND VOLUME → NORMAL VOLUME |
| | (GIVEN TIME (e.g., 24 HOURS) ELAPSES) | | | | | |
| 5 | RESET AIR INTRUSION FLAG | 0 | 0 | 1 → 0 | 0 → 0 | |

X = 1, 0
1ST VOLUME : 2ND DISPENSABLE INK VOLUME
NORMAL VOLUME : NORMAL DISPENSABLE INK VOLUME

1ST VOL : 1ST DISPENSABLE INK VOLUME
2ND VOL : 2ND DISPENSABLE INK VOLUME
NOR. VOL : NORMAL DISPENSABLE INK VOLUME

V0 : NORMAL DISPENSABLE INK VOLUME
V1 : 1ST DISPENSABLE INK VOLUME
V2 : 2ND DISPENSABLE INK VOLUME

1ST VOL : 1ST DISPENSABLE INK VOLUME
2ND VOL : 2ND DISPENSABLE INK VOLUME
NOR. VOL : NORMAL DISPENSABLE INK VOLUME

INK END CONDITION

INK FILLED CONDITION

IMAGE FORMING APPARATUS USING LIQUID FOR FORMING IMAGES

CROSS-REFERENCE TO RELATED APPLICATIONS

This application claims priority to Japanese Patent Application No. 2008-194296, filed on Jul. 29, 2008 and No. 2009-014699, filed on Jan. 26, 2009 in the Japan Patent Office, which are hereby incorporated by reference herein in their entirety.

BACKGROUND

1. Technical Field

This disclosure relates to an image forming apparatus having a recording head to jet liquid droplets and a sub-tank to supply liquid such as ink to the recording head.

2. Description of the Background Art

In general, image forming apparatuses are commercially available as printers, facsimile machines, copiers, plotters, or multi-functional apparatuses having several of these functions. Such image forming apparatus may include a liquid dispensing unit having a liquid dispensing head (or a recording head) for dispensing droplets of recording liquid onto a recording sheet to form an image on the recording sheet.

It is to be noted that such sheet includes, but is not limited to, a medium made of material such as paper, string, fiber, cloth, leather, metal, plastic, glass, timber, and ceramic, for example. Further, the term "image formation" used herein in this patent specification refers to providing, recording, printing, or imaging an image, a letter, a figure, or a pattern to a sheet or a plate. Moreover, the term "liquid" used herein is not limited to recording liquid or ink but includes anything jetted in fluid form and capable of forming an image. Hereinafter, the recording liquid is referred to as ink solely for simplicity of description, and "ink" means any kind of liquid that can be dispensed from a jetting head, including but not limited to ink used for inkjet printers, deoxyribonucleic acid (DNA) samples, resist pattern material, patterning material, or the like.

Furthermore, a liquid dispensing unit having a liquid dispenser head can be used in any application area, including, but not limited to, forming an image on a sheet, dispensing liquid for specific purposes (e.g., fabrication of semiconductors), and the like. Such liquid dispensing units or image forming apparatuses have found industrial applications in such fields as cloth-printing apparatuses and metal wiring devices.

Such image forming apparatus may be a serial type image forming apparatus or a line type image forming apparatus. In the serial type image forming apparatus, a recording head moves in a main scanning direction to jet liquid droplets to form an image on a recording medium. In the line type image forming apparatus, a page-wide array (PWA) stationary recording head is used to jet liquid droplets to form an image on a recording medium.

Such image forming apparatus may include a sub-tank (also referred to as a head tank, a buffer tank, or the like) used for supplying ink to the recording head. Further, the sub-tank may include a negative pressure generator to generate negative pressure to prevent spillover or dropping of ink from nozzles of the recording head.

Such sub-tank may include an ink storage container for storing ink, a flexible member (e.g., film member), and an elastic member. The flexible member seals an opening disposed at one side of the ink storage container, and the elastic member biases the flexible member to an outward direction constantly. Such flexible member and the elastic member compose a negative pressure generator or negative pressure generation system. Further, the sub-tank includes an atmosphere-communicable unit, by which an internal space of the ink storage container can communicate with the atmosphere. The atmosphere-communicable unit has a valve that can be opened and closed at a given timing. With such a configuration, ink can be supplied from the ink storage container to the recording head effectively.

In such image forming apparatus, it can happen that gas bubble (e.g., air) may intrude into an ink supply route connected to the sub-tank. If the gas bubble is transported to the recording head, jetting malfunction may occur in the recording head, by which image quality deteriorates.

JP-2007-223230-A describes one configuration devised to cope with such gas bubble intrusion. Specifically, when it is determined that there is an increased probability of gas bubble (e.g., air) intrusion into the ink supply route, an air intrusion flag is set to 1. Subsequently, ink and air are transported to the sub-tank, and then the sub-tank may be left for for a predetermined period of time until the gas bubble in the sub-tank disappears. Specifically, until it is determined that the gas bubble in the sub-tank disappears, an ink supply under an atmosphere-communicated condition is not supplied to the sub-tank, wherein the ink supply under the atmosphere-communicated condition is conducted by communicating an internal space of the sub-tank to atmosphere.

Further, JP-2007-105935-A describes another configuration to cope with such gas bubble intrusion. Specifically, such configuration includes a functional unit to detect a load level of a drive motor driving a supply pump that supplies ink from a main tank to a sub-tank. When a given level of load is detected (e.g., load level deviating from normal range), the supply pump is stopped to prevent gas bubble intrusion in the supply pump, by which gas bubble intrusion into the sub-tank can be reduced.

Further, JP-2008-49672-A describes yet another configuration to cope with such gas bubble intrusion. Specifically, in such configuration, gas dissolved in a liquid such as ink in one chamber is detected. When the dissolved gas is detected, such dissolved gas is transported to a gas ejection chamber, separately provided, and dissolved in another liquid in the gas ejection chamber.

The most common way for bubbles of air or gas to get into the ink supply route is when the ink runs out while the ink pump continues to operate. Typically, an image forming apparatus such as an inkjet printing system employs an ink supply system connecting a main tank and a sub-tank, in which ink is supplied from the main tank to the sub-tank. In such system, when ink in the main tank is consumed completely and the ink cannot be supplied to the sub-tank, the main tank needs to be replaced with a new main tank. Such ink-consumed condition of the main tank may be referred to as "ink end condition" of the main tank.

The main tank having the ink end condition needs to be replaced with a new one. However, such replacement takes time. If an image forming operation of the image forming apparatus has to be stopped to replace the main tank, a user may feel inconvenienced by such replacement period because the image forming operation is interrupted due to replacement of the main tank. The user may feel especially inconvenienced if the "ink end condition" of main tank occurs without any advance notice.

In view of such user inconvenience, it is possible to configure the apparatus to detect a near-empty state of the main tank, which can be referred to as an "ink near-end condition"

and which occurs before the ink end condition occurs. In the ink near-end condition, the amount of ink remaining in the main tank approaches an ink-completely-consumed condition but is still sufficient for image formation. Such ink near-end condition can be reported to a user via a display panel or the like.

Such ink near-end condition may be determined with reference to an ink consumption amount, which is the amount of ink consumed by image forming operations or other operations that consume ink. In practice, the ink consumption amount is computed using an electronic counting method, and the computed ink consumption amount is used to determine an "ink remaining amount" in the main tank. The main tank is designed to store a given known volume of ink, which is referred to as designed ink capacity for the main tank. Accordingly, the ink remaining amount in the main tank can be computed by subtracting the ink consumption amount from the designed ink capacity for the main tank, such that "ink remaining amount=designed ink capacity−ink consumption amount"

The ink near-end condition may be set for the main tank when the ink remaining amount decreases to a given amount or less. As for the above-mentioned ink consumption amount computed by the electronic counting method, this amount consists mainly of two types of ink consumption: 1) ink consumed for image forming operations, which may be referred to as recording ink consumption; and 2) ink consumed for refreshing operation of the recording head, which may be referred to as refreshing ink consumption.

1) recording ink consumption can be computed by multiplying the number of jetted droplets by the volume of each single jetted droplet dispensed during image forming operations.

2) refreshing ink consumption can be computed by multiplying the number of times that the refreshing operation of the recording head is conducted by the volume of liquid used for a single refreshing operation.

Accordingly, the ink consumption amount can be computed by adding the recording ink consumption and the refreshing ink consumption. The electronic counting method is conducted using ink-related data specified by an apparatus design.

In general, actual ink consumption amount and the ink consumption amount computed by the electronic counting method may be different. In some cases, the discrepancy between the actual ink consumption amount and the computed ink consumption amount may be great. Such discrepancy may be caused by several factors, such as environmental conditions (e.g., temperature, humidity), the operational condition of the apparatus, and so forth. Under certain conditions, the actual ink consumption amount may exceed the computed ink consumption amount. In that case, the main tank may be already shifted to the ink end condition from the ink near-end condition but the ink remaining amount computed by the electronic counting method may still not indicate the ink near-end condition.

If the main tank enters the ink end condition, it becomes hard to continue image forming operations for an extended time. However, the ink end condition of the main tank may not necessarily mean that image forming operations cannot be continued, because the image forming operation can be continued for some time, although such time may not be so long, using ink remaining in the sub-tank. During such period, the ink near-end condition can be reported to a user, by which the user can be prompted to replace the main tank before image forming operations can no longer be continued at all.

As above described, ink is supplied from the ink storage container of the sub-tank to the recording head. In addition to the ink storage container, the sub-tank also includes the flexible member (e.g., film member) disposed at one side of the ink storage container and the elastic member for biasing the flexible member outward. The flexible member and the elastic member for biasing are used as the negative pressure generator, and the sub-tank includes the atmosphere-communicable unit. The atmosphere-communicable unit is used to communicate an internal space of the ink storage container to the atmosphere. Specifically, when the atmosphere-communicable unit is activated, the internal space of the ink storage container is communicated to the atmosphere (i.e., open condition), and when the atmosphere-communicable unit is not activated, the internal space of the ink storage container is not communicated to the atmosphere (i.e., closed condition).

Under normal operating conditions, as ink is consumed from the sub-tank, the flexible member is deformed, changing its shape from an inflated shape to a deflated shape; then, as the sub-tank is filled with ink, the flexible member is restored to its inflated shape from the deflated shape.

The above-mentioned ink near-end condition can be extended by extending a period of ink supply operation from the sub-tank. By extending the ink near-end condition by using ink in the sub-tank, the user has time to prepare a new main tank for installation during such ink near-end condition.

However, if the sub-tank is used for an extended period of time, more of the ink in the sub-tank may be consumed. If a greater amount of ink is consumed from the sub-tank, the flexible member may be deformed greatly. If the flexible member is deformed greatly, the flexible member may not be restored to its inflated shape from the deflated shape by a normal ink supply operation alone. Such condition of the flexible member is referred to as hysteresis of the flexible member.

The normal ink supply operation is an operation of supplying ink from the main tank to the sub-tank by using a supply pump, wherein such normal ink supply operation is conducted when ink is supplied from the main tank, storing sufficient ink, to the sub-tank, receiving ink from the main tank at a given timing, and storing sufficient ink constantly.

When hysteresis of the flexible member remains, the sub-tank cannot be correctly filled with ink even if the main tank is replaced with a new one and then ink is supplied from the main tank to the sub-tank.

Typically, the flexible member is used to detect an ink-full condition of the sub-tank. Specifically, as ink is filled in the sub-tank, the flexible member can be expanded outward from the sub-tank. Under a normal ink filling operation, the flexible member can be expanded effectively, and thereby the ink-full condition of the sub-tank can be detected correctly.

However, if ink is supplied to the sub-tank while hysteresis of the flexible member remains, a movement of the flexible member may not correctly follow the ink supply operation, making it difficult to determine whether ink is correctly supplied to the sub-tank.

Such hysteresis of the flexible member can be removed by filling ink while communicating the internal space of the sub-tank to the atmosphere because the flexible member can be expanded completely using atmospheric pressure. However, if the sub-tank intruded with gas bubble (e.g., air) is communicated to the atmosphere, a problem may occur in that such gas bubble does not disappear so easily because the ink generally includes a surfactant component.

Moreover, an ink level (or height of the ink) in the sub-tank can be detected using a detector such as detection electrodes, in which the ink level can be correctly detected when the detection electrodes detects a given electrical resistance corresponding to ink conductivity. However, the intrusion of gas bubbles into the sub-tank can cause the detection electrodes to generate false readings because the electrical resistant of the gas bubble and the electrical resistance of the ink are different. In short, the ink level in the sub-tank may not be detected accurately or detection of the ink level may be delayed. If the detection of the ink level is delayed, an actual ink supply volume in the sub-tank may exceed the specified design volume of the sub-tank. Accordingly, some ink may spill over to an atmosphere-communicable unit and cause operational failures of the atmosphere-communicable unit. For example, ink may contaminate the atmosphere-communicable unit, which may cause the atmosphere-communicable unit to malfunction.

BRIEF SUMMARY

In an aspect of this disclosure, there is provided an image forming apparatus that includes a recording head, a sub-tank, a main tank, a supply unit, a memory, and a controller. The recording head dispenses ink droplets. The sub-tank stores ink to be supplied to the recording head. The sub-tank includes an ink storage container, a flexible member, an elastic member, and an atmosphere-communicable unit. The ink storage container, storing ink, has an opening at one side of the ink storage container. The flexible member seals the opening of the ink storage container. The flexible member is movable in response to ink condition in the ink storage container. The elastic member biases the flexible member outward from the ink storage container. A combination of the flexible member and the elastic member is used as a negative pressure generator. The atmosphere-communicable unit, disposed to the ink storage container, is settable to an open condition and a closed condition. The atmosphere-communicable unit is set to the open condition to communicate an internal space of the ink storage container to atmosphere. The main tank, detachably mounted to the image forming apparatus, stores ink to be supplied to the sub-tank. The supply unit supplies ink from the main tank to the sub-tank. The memory stores data related to an image forming operation. The controller controls an ink dispensing operation depending on image forming conditions. The controller determines whether a gas bubble intrudes into the sub-tank. The controller sets a first gas history flag when it is determined that the gas bubble intrudes in the sub-tank and stores the first gas history flag to the memory, and sets a second gas history flag when it is determined that the gas bubble does not exist in the sub-tank and stores the second gas history flag to the memory. The controller executes the ink dispensing operation from the recording head using ink remaining in the sub-tank while setting a dispensable ink volume, which is a threshold ink volume dispensable from the recording head when an ink supply from the main tank to the sub-tank is unable to be continued. The controller variably sets a first dispensable ink volume set for the first gas history flag and a second dispensable ink volume for the second gas history flag, and the first dispensable ink is smaller than the second dispensable ink volume. The controller determines that an ink end condition occurs when the recording head dispenses the dispensable ink volume from the sub-tank, and when the ink end condition is determined, the main tank is replaced with a new main tank.

In another aspect, there is provided an ink dispensing operation control method for an image forming apparatus. The image forming apparatus includes a recording head, a sub-tank, a main tank, a supply unit, a memory, and a controller. The recording head dispenses ink droplets. The sub-tank stores ink to be supplied to the recording head. The sub-tank includes an ink storage container, a flexible member, an elastic member, and an atmosphere-communicable unit. The ink storage container, storing ink, has an opening at one side of the ink storage container. The flexible member seals the opening of the ink storage container. The flexible member is movable in response to ink condition in the ink storage container. The elastic member biases the flexible member to outward from the ink storage container. A combination of the flexible member and the elastic member is used as a negative pressure generator. The atmosphere-communicable unit, disposed to the ink storage container, is settable to an open condition and a closed condition. The atmosphere-communicable unit is set to the open condition to communicate an internal space of the ink storage container to atmosphere. The main tank, detachably mounted to the image forming apparatus, stores ink to be supplied to the sub-tank. The supply unit supplies ink from the main tank to the sub-tank. The memory stores data related to an image forming operation. The controller controls an ink dispensing operation depending on image forming conditions. The ink dispensing operation control method for the image forming apparatus including the steps of: determining whether a gas bubble intrudes into the sub-tank; setting a first gas history flag when it is determined that the gas bubble intrudes in the sub-tank and storing the first gas history flag to the memory; setting a second gas history flag when it is determined that the gas bubble does not exist in the sub-tank and storing the second gas history flag to the memory; executing with the controller the ink dispensing operation from the recording head using ink remaining in the sub-tank while setting a dispensable ink volume, which is a threshold ink volume dispensable from the recording head when an ink supply from the main tank to the sub-tank is unable to be continued; variably setting a first dispensable ink volume for the first gas history flag and a second dispensable ink volume for the second gas history flag, and the first dispensable ink is smaller than the second dispensable ink volume; determining that an ink end condition occurs when the recording head dispenses the dispensable ink volume from the sub-tank; and replacing the main tank with a new main tank when the ink end condition is determined.

BRIEF DESCRIPTION OF THE DRAWINGS

A more complete appreciation of the disclosure and the aforementioned and other aspects, features and advantages can be better understood from the following detailed description with reference to the accompanying drawings, wherein:

FIG. 12A is a cartridge replacement sequence chart according to first example embodiment, in which the air intrusion flag is set to 1;

FIG. 14A is a cartridge replacement sequence chart according to first example embodiment, in which the air intrusion flag is set to 0;

Figure 1:
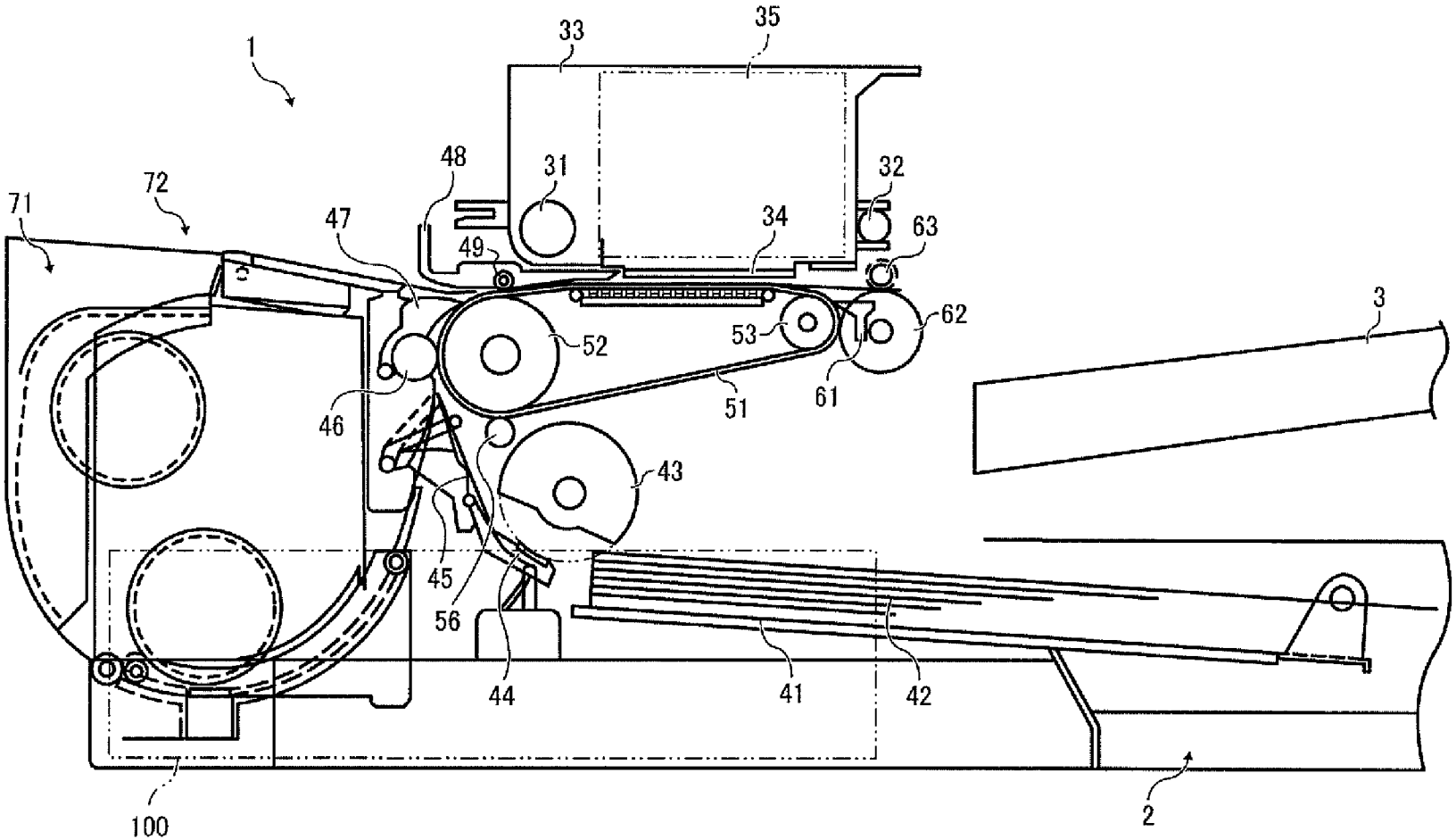
FIG. 1 illustrates a schematic configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to FIGS. 1 and 2. The image forming apparatus may employ inkjet system, for example, but not limited thereto.

FIG. 1 illustrates a cross-sectional view of an image forming apparatus 1 according to an exemplary embodiment. FIG. 2 illustrates a plan view of printing section of the image forming apparatus 1 shown in FIG. 1.

The image forming apparatus 1 may be a serial type inkjet recording machine. As shown in FIG. 2, the image forming apparatus 1 has a first side plate 21A and a second side plate 21B at both end of the image forming apparatus 1. Guide rods 31 and 32 extend between the first side plate 21A and the second side plate 21B as guide member of a carriage 33. Accordingly, the carriage 33 may slidably move in a main scanning direction along the guide rods 31 and 32. For example, the carriage 33 can move in a main scanning direction shown by an arrow MD in FIG. 2 using a motor and timing belt.

The carriage 33 may include an ink jetting head to jet or dispense recording liquid droplets (hereinafter, may be referred to as "ink," "ink droplet"). For example, an ink jetting head may be consisted of a plurality of recording heads 34. The recording head 34 may have a plurality of nozzles arranged in a direction perpendicular to a main scanning direction (i.e., sub-scanning direction), and ink can be dispensed to a downward direction from the plurality of nozzles. For example, the plurality of the recording heads 34 may include the recording heads 34*a* and 34*b* for jetting yellow(Y) ink, magenta(M) ink, cyan(C) ink, and black(K) ink. Such plurality of the recording head 34 may be referred the recording head 34.

Each of the recording heads 34*a* and 34*b* has two arrays of nozzles. For example, one array of nozzles in the recording head 34*a* jets black(K) ink, and other array of nozzles in the recording head 34*a* jets cyan(C) ink; one array of nozzles in the recording head 34*b* jets magenta(M) ink, and other array of nozzles in the recording head 34*b* jets yellow(Y) ink.

The cartridge unit 4 includes an ink cartridge 10, and a front cover. The ink cartridge 10 is used as a main tank to store recording liquid (e.g., ink) to be supplied to the recording head 34. The ink cartridge 10 is detachably mounted in the cartridge unit 4 so that ink cartridge 10 can be replaced with new cartridge at a given timing. The front cover can be opened and closed.

Further, the carriage 33 may include sub-tanks 35*a* and 35*b* to supply recording liquid of each color to the recording heads 34*a* and 34*b*. The sub-tanks 35*a* and 35*b* may be referred to as the sub-tank 35. As shown in FIG. 2, the sub-tanks 35*a* and 35*b* may be connected to the ink cartridges 10*y*, 10*m*, 10*c*, and 10*k* via a supply tube 36 so that recording liquid (e.g., ink) can be supplied to the sub-tank 35 from the ink cartridge 10. As shown in FIG. 2, the ink cartridge 10 is set in the cartridge unit 4, and the cartridge unit 4 includes a supply pump unit 24 to supply recording liquid in the ink cartridge 10 to the sub-tank 35 via the supply tube 36.

As show in FIG. 1, the image forming apparatus 1 includes a sheet feed section. The sheet feed section includes a sheet holder 41 to stack a given volume of sheet 42 in a sheet feed tray 2. The sheet 42 stacked on the sheet holder 41 is separated one by one using a sheet feed roller 433 having a half-moon shape. Further a separation pad 44 made of a material having a greater friction coefficient faces the sheet feed roller 43 while the separation pad 44 is pressed to the sheet feed roller 43.

Then, the sheet 42 is fed from the sheet feed section the transport section, in which the sheet 42 is transported under the recording head 34.

The transport section may include a transport belt 51, a guide member 45, a counter roller 46, a transport guide 47, a pressure member 48, a pressure roller 49, and a charge roller 56, for example.

The sheet 42 is guided from the sheet feed section using the guide member 45, and then further guided to a nip portion between the transport belt 51 and the counter roller 46. The transport guide 47 is used to change a sheet movement direction of the sheet 42 toward the transport belt 51. The pressure member 48 presses the pressure roller 49 toward the transport belt 51. The charge roller 56 charges a surface of the transport belt 51 at a given potential. The transport belt 51 transports the sheet 42 to a position facing the recording head 34 while attracting the sheet 42 using electrostatic force charged by the charge roller 56.

The transport belt 51 is an endless belt extended by a transport roller 52 and a tension roller 53. The transport belt 51 can be traveled in a given direction as belt moving direction (or sub-scanning direction) as shown by an arrow SD in FIG. 2. The charge roller 56 may contact a surface layer of the transport belt 51, and may be rotated when the transport belt 51 rotate. The transport belt 51 can travel in the belt moving direction shown by an arrow SD in FIG. 2 by driving the transport roller 52 using a motor and a timing belt.

Now, a sheet ejection section, which ejects the sheet 42 having an image recorded by the recording head 34, is described. The sheet ejection section may include a separation claw 61, an ejection roller 62, an ejection roller 63, for example. The separation claw 61 separates the sheet 42 from the transport belt 51. A sheet ejection tray 3 is disposed under the ejection roller 62.

Further, a sheet face inverting unit 71 may be detachably mounted to a back side of the image forming apparatus 1. The sheet face inverting unit 71 receives a sheet from the transport belt 51 when the transport belt 51 travels in an inverse direction, and the sheet face inverting unit 71 inverts a face of the sheet 42, and then feeds the face-inverted sheet to the nip between the counter roller 46 and the transport belt 51. Further, a manual sheet feeder 72 may be disposed on the sheet face inverting unit 71.

Figure 2:
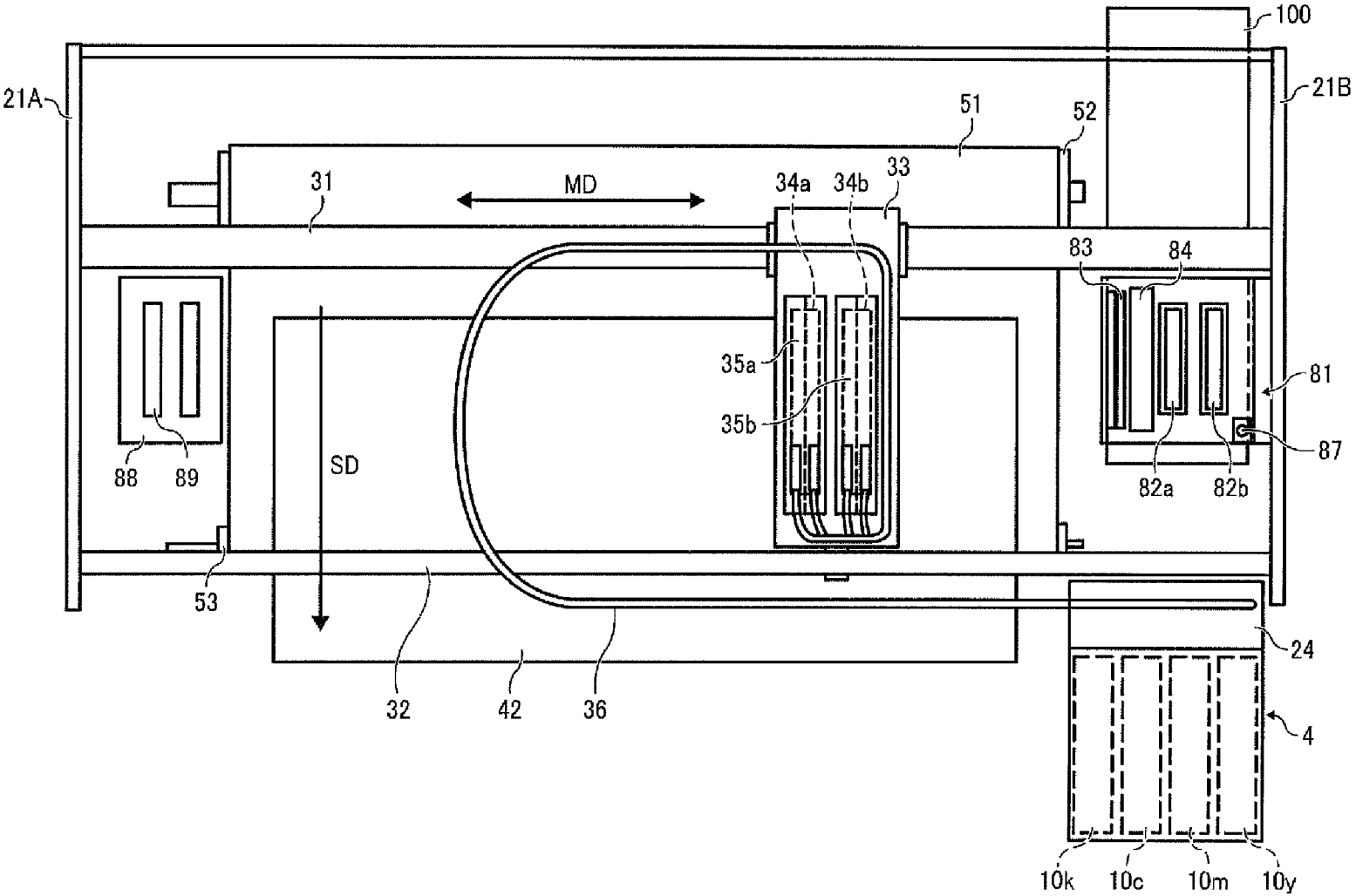
FIG. 2 illustrates a plan view of an image forming engine of the image forming apparatus of FIG. 1.

Further, as shown in FIG. 2, a refreshing unit 81 is disposed at a non-printing area set at one end of scanning direction of the carriage 33. The refreshing unit 81 may include a mechanism to maintain and refresh nozzle performance condition of the recording head 34.

The refreshing unit 81 may include a cap 82, a wiper blade 83, a dummy discharge receiver 84, and a carriage lock 87, for example. The cap 92 may include the caps 92*a* and 92*b* to cap a nozzle face of each of the recording heads 34. The wiper blade 83 wipes the nozzle face of recording head 34. The dummy discharge receiver 84 receives ink, which is dispensed to eject viscosity-increased recording liquid from the nozzle, wherein such dummy discharge of ink is conducted without forming an image. The carriage lock 87 locks the carriage 33.

Further, a waste ink tank 100 having an opening is disposed under the refreshing unit 81 to store waste ink generated by a maintenance operation and refreshing operation for the recording head 34. The waste ink tank 100 may be detachably mounted to the image forming apparatus 1 so that the waste ink tank 100 is replaceable with a new one.

Further, as shown in FIG. 2, at another non-printing area for a scanning direction of the carriage 33, another dummy discharge receiver 88 is arranged. Another dummy discharge receiver 88 receives dummy discharged ink, which is discharged during an image forming operation to eject viscosity-increased recording liquid from the nozzle. Another dummy discharge receiver 88 may include an opening 89 extending in a nozzle array direction of the recording head 34.

The image forming apparatus 1 shown in FIG. 1 and FIG. 2 may be used as an inkjet recording machine, for example. A description is now given to an image forming operation conductable in the image forming apparatus 1.

When the sheet 42 is fed from the sheet feed tray 2 one by one to the guide member 45, the sheet 42 is guided to an upward direction. Then, the sheet 42 is fed to a nip between the transport belt 51 and the counter roller 46. With a guiding effect of the transport guide 37 and a pressure effect of the pressure roller 49, a transportation direction of the sheet 42 is changed for about ninety degrees, and then the sheet 42 is transported on the transport belt 51.

During such sheet transportation, a positive voltage and negative voltage current are supplied to the charge roller 56 from a high voltage power source (not illustrated) alternately. Therefore, the transport belt 51 is alternately charged with positive and negative voltage, thereby positive voltage charged areas and negative voltage charged areas are formed on the transport belt 51 alternately. When the sheet 42 is fed on such charged transport belt 51, the sheet 42 is electrostatically adhered on the transport belt 51, and is transported to the recording section with a traveling of the transport belt 51.

As illustrated in FIG. 2, the carriage 33 having the recording head 34 can be moved in a main scanning direction shown by an arrow MD over the sheet 42. The recording head 34 jets droplets (e.g., ink) onto the sheet 42 to record one line image on the sheet 42 when the carriage 34 moves in a direction shown by an arrow MD. During an image forming operation, a transportation of the sheet 42 is stopped for recording one line image on the sheet 42. When the recording of one line image completes, the sheet 42 is transported for a given distance and another one line image is recorded on the sheet 42 by jetting droplets (e.g., ink) onto the sheet 42. Such recording process is repeated for one page. When such recording operation completes for one page, the sheet 42 is ejected to the sheet ejection tray 3.

Further, when an image forming operation is suspended, the carriage 33 may be moved to the refreshing unit 81, an then the cap 82 caps the recording head 34 to maintain nozzles at moist condition (or wet condition), by which jetting malfunction caused by dried ink can be prevented.

Further, while capping the recording head 34 with the cap 82, recording liquid can be sucked from nozzles ("nozzle suction" or "head suction") to eject viscosity-increased recording liquid or gas bubble from nozzles, by which the recording head 34 can be refreshed to a good level of jetting performance. The recording head 34 can be refreshed to a good level of jetting performance by conducting a dummy discharge which discharge liquid droplet without forming an image over the refreshing unit 81. With such refreshing operation, the recording head 34 can be maintained at a good level of jetting performance over time.

Figure 3:
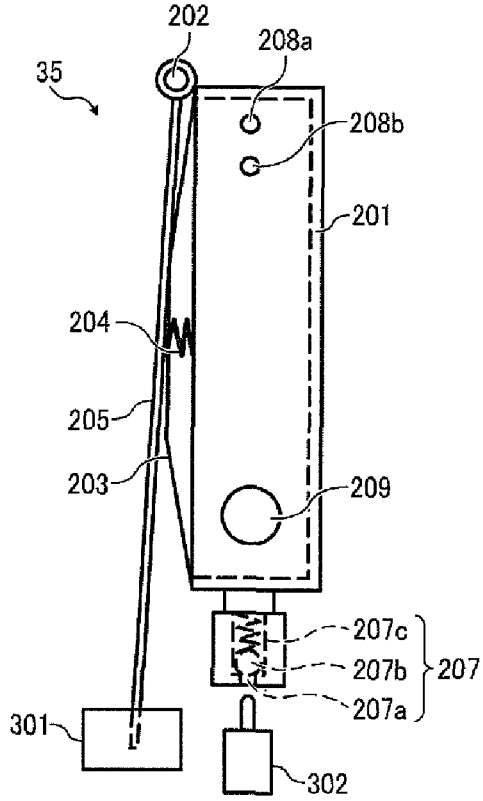
FIG. 3 illustrates a schematic plan view of a sub-tank of the image forming apparatus of FIG. 1.
Figure 4:
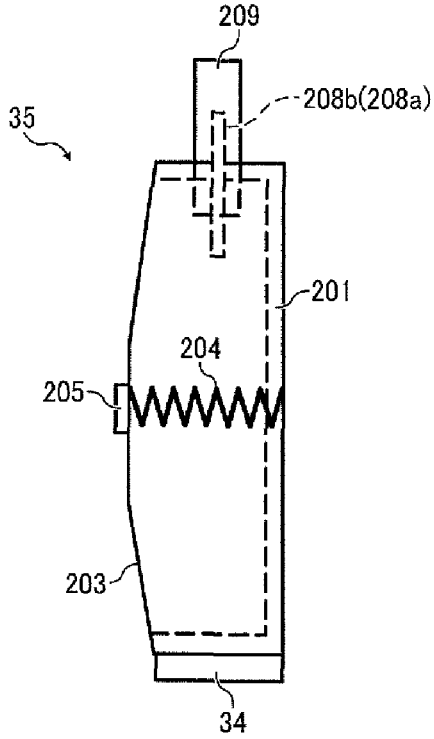
FIG. 4 illustrates a schematic front view of the sub-tank of FIG. 3.

A description is now given to the sub-tank 35 with reference to FIGS. 3 and 4. FIG. 3 illustrates a schematic plan view of the sub-tank 35, and FIG. 4 illustrates a schematic front view of the sub-tank 35. The sub-tank 35 may include a tank casing 201, a flexible film 203, and a spring 204, for example.

The tank casing 201, used as an ink storage container having a given ink storage capacity, stores ink, and has an opening on one side of the tank casing 201. The flexible film 203, used as a flexible member, seals the opening of the tank casing 201. The spring 204, used as an elastic member, is disposed inside the tank casing 201 to bias the flexible film 203 to an outward direction constantly. As such, the flexible film 203 can be biased to the outward direction of the tank casing 201 using a biasing force applied by the spring 204. A combination of the flexible film 203 (i.e., flexible member) and the spring 204 (i.e., elastic member) can be used as a negative pressure generator for the sub-tank 35. Specifically, after filling ink in the tank casing 201, some amount of ink in the tank casing 201 is jetted and sucked by the refreshing unit 81, by which the flexible film 203 is pulled toward the inside of the tank casing 201. Because the flexible film 203 is constantly biased by the spring 204 to the outward direction of the tank casing 201, the flexible film 203, pulled to the inside of the tank casing 201 when ink is sucked by the refreshing unit 81, can be expanded to the outward direction of the tank casing 201 for some distance, by which a negative pressure can be generated in the tank casing 201.

Further, the sub-tank 35 may include a displacement member 205, which is disposed outside the tank casing 201. The displacement member 205 may be generally called as a filler. The displacement member 205 is pivotably supported by a pivot axis 202 at one end of the displacement member 205. Further, a given portion of the displacement member 205 may be attached on the flexible film 203 using adhesives, for example. Accordingly, as the flexible film 203 moves, the displacement member 205 also moves interlockingly.

When the displacement member 205 is moved, an ink amount detection sensor 301 detects movement of the displacement member 205, in which ink amount remaining in the sub-tank 35 may be determined in view of a movement distance of the displacement member 205. The ink amount detection sensor 301 may be an optical sensor disposed to the image forming apparatus 1.

Further, the tank casing 201 includes a supply hole 209 on its upper portion. The supply hole 209 is connected to the supply tube 36 so that ink can be supplied from the ink cartridge 10 into the tank casing 201 of the sub-tank 35 through the supply tube 36.

Further, an atmosphere-communicable unit 207 is provided on one side of the tank casing 201. The atmosphere-communicable unit 207 is activated when to communicate an internal space of the sub-tank 35 to atmosphere. The atmosphere-communicable unit 207 may include an air release path 207*a*, a valve body 207*b*, a spring 207*c*, and a solenoid 302, for example. The valve body 207*b* can be moved in a given direction to open and close the air release path 207*a*. When the air release path 207*a* is opened, the internal space of the sub-tank 35 is communicated to the atmosphere; when the air release path 207*a* is closed, the internal space of the sub-tank 35 is not communicated to the atmosphere. The spring 207*c* biases the valve body 207*b* to a closed condition constantly. Specifically, when the solenoid 302, disposed to the image forming apparatus 1, presses the valve body 207*b*, the air release path 207*a* is opened, by which the internal space of the sub-tank 35 is communicated to the atmosphere.

Further, electrode pins 208*a* and 208*b* may be inserted in the sub-tank 35 to detect an ink level or height in the sub-tank 35. Ink has a given level of electrical conductivity. Accordingly, when the electrode pins 208*a* and 208*b* disposed in the sub-tank 35 are soaked or immersed by ink, an electric current flows between the electrode pins 208*a* and 208*b*, by which electric resistance between the electrode pins 208*a* and 208*b* changes. Based on an electric resistance value detected by the electrode pins 208*a* and 208*b*, it can be determined whether the ink level becomes a given level. For example, it is determined that the ink level becomes a given height or more when the electric resistance becomes a given value, or it is determined that the ink level becomes a given height or less when the electric resistance becomes another given value.

Figure 5:
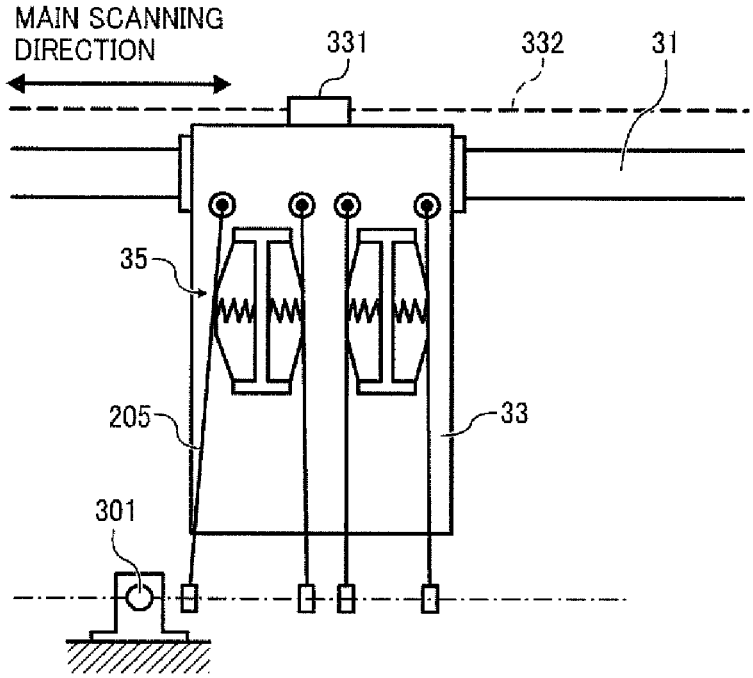
FIG. 5 illustrates a schematic plan view of the sub-tank of FIG. 3, in which ink-filled condition is detected.

A description is now given to a configuration for detecting ink level in the sub-tank 35 with reference to FIG. 5. As shown in FIG. 5, a filler detection sensor 301 is disposed to the image forming apparatus 1, for example. The filler detection sensor 301 may be a translucent optical sensor. When the carriage 33 moves in a main scanning direction, an edge of the displacement member 205 passes a given position, then the filler detection sensor 301 detects the displacement member 205.

Further, an encoder sensor 331 and an encoder scale 332 are disposed to detect a present position of the carriage 33 in a main scanning direction. Specifically, the encoder scale 332 is disposed along a main scanning direction of carriage movement. Accordingly, the carriage 33 can be detected by reading the encoder scale 332 by the encoder sensor 331.

With such a configuration, ink remaining amount in the sub-tank 35 or ink-filled condition in the sub-tank 35 can be determined by the filler detection sensor 301 and the displacement member 205, wherein the carriage 33 may be positioned at a given position along the main scanning position when to detect the ink-filled condition of the sub-tank 35.

For example, the ink-filled condition can be detected as below: at first, the carriage 33 is stopped at a given position along the main scanning position. As ink is being supplied to the sub-tank 35 from the ink cartridge 10, the displacement member 205 changes its position in correspondence to ink volume supplied in the sub-tank 35. When the sub-tank 35 is filled with ink, the displacement member 205 moves in a position to be detectable by the filler detection sensor 301. Accordingly, when the filler detection sensor 301 detects the displacement member 205, it is determined that the sub-tank 35 is set to the ink-filled condition.

Further, the ink-filled condition of the sub-tank 35 can be detected using the detection electrode pins 208*a* and 208*b*. For example, an electric resistance between the detection electrode pins 208*a* and 208*b* may change as ink is supplied to the sub-tank 35 from the ink cartridge 10. Accordingly, it can be determined that the sub-tank 35 becomes the ink-filled condition when electric current flows between the detection electrode pins 208*a* and 208*b*.

In the image forming apparatus 1, the ink-filled condition of the sub-tank 35 may be determined using the detection electrode pins 208*a* and 208*b* or the filler detection sensor 301: In one case, when an ink filling operation is conducted under an atmosphere-communicated condition, the detection electrode pins 208*a* and 208*b* may be used, in which ink is filled from the ink cartridge 10 to the sub-tank 35 while setting an open condition for the atmosphere-communicable unit 207 of the sub-tank 35; In another case, when an ink filling operation is conducted under an atmosphere-not-communicated condition, the filler detection sensor 301 may be used, in which ink is filled from the ink cartridge 10 to the sub-tank 35 while setting a closed condition for the atmosphere-communicable unit 207 of the sub-tank 35. However, the ink-filled condition of the sub-tank 35 can be determined using other methods.

Figure 6:
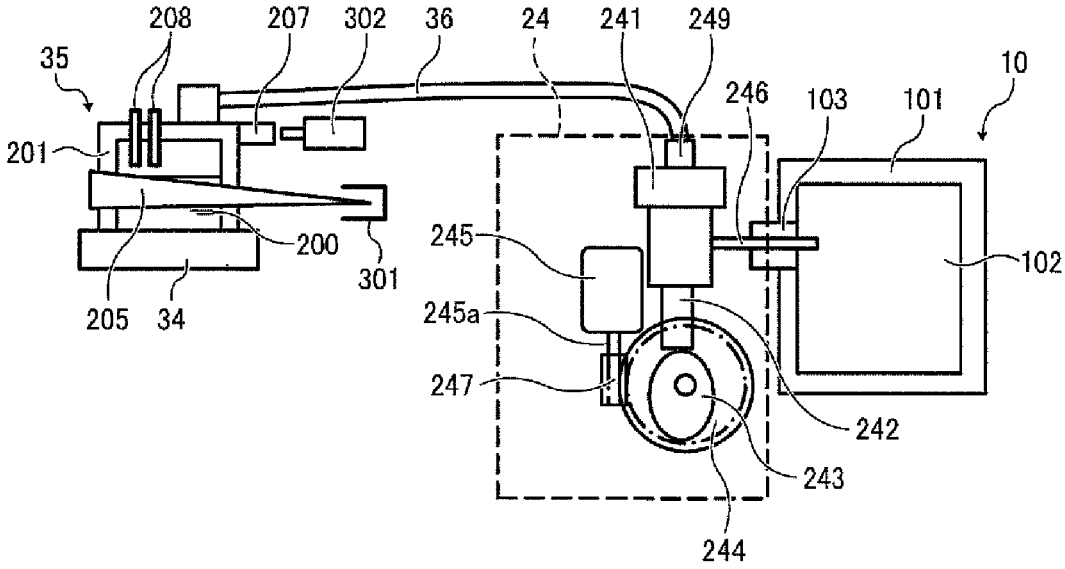
FIG. 6 illustrates a schematic configuration of an ink supply system employed for the image forming apparatus of FIG. 1.

A description is now given to an ink supply system to supply ink to the recording head 34 with reference to FIG. 6. FIG. 6 illustrates a schematic configuration of the ink supply system. As shown in FIG. 6, the ink cartridge 10 may include a cartridge casing 101, an ink bag 102 disposed in the cartridge casing 101, and an ink supply mouth 103. The ink bag 102, made of a flexible material, stores ink therein. The ink bag 102 includes the ink supply mouth 103, which is used to feed ink to an outside of the ink bag 102. The ink supply mouth 103 may include an elastic member such as rubber, for example.

Further, the supply pump unit 24, used as a supply unit, may include a supply pump 241 having a piston 242, a cam 243, a gear 244, and an ink supply motor 245, for example. The supply pump 241 is used to supply ink from the ink cartridge 10 to the sub-tank 35. The cam 243 is used to reciprocate the piston 242 of the supply pump 241 into an upper and lower side direction in FIG. 6. The gear 244 is used to rotate the cam 243. The ink supply motor 245 includes a motor shaft 245*a* and a gear 247, attached to the motor shaft 245*a* and meshed to the gear 244. When the ink supply motor 245 is activated, the gear 244 can be rotated by the gear 247. As such, the ink supply motor 245 may be used as a pump drive unit. The supply pump 241 may include a hollow member 246, which is inserted in an elastic member (e.g., rubber cover) of the ink supply mouth 103 of the ink bag 102 in the ink cartridge 10 to couple the supply pump 241 and the ink bag 102.

Figure 7:
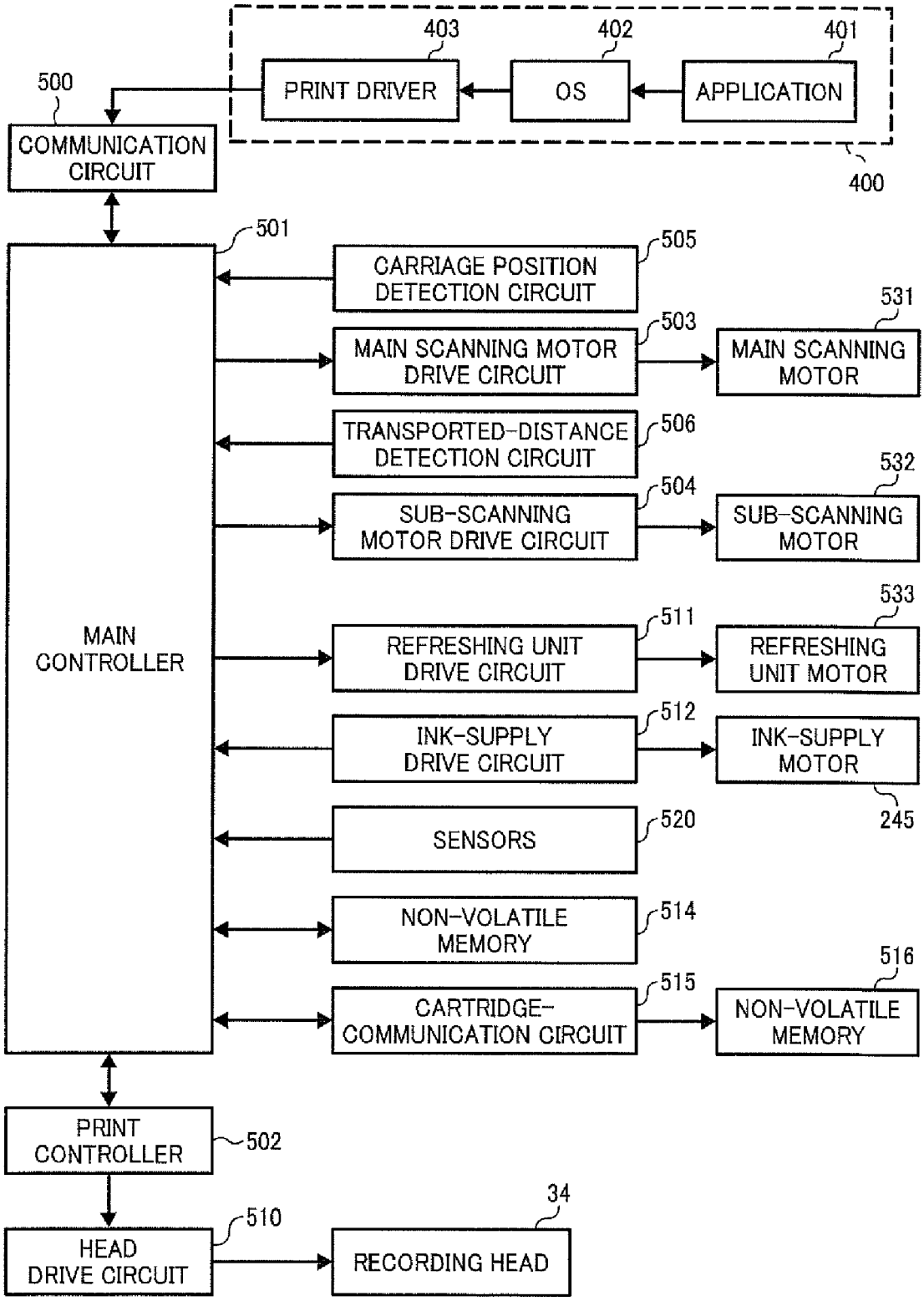
FIG. 7 is a block diagram of a control system of the image forming apparatus of FIG. 1.

A description is now given to a control system of the image forming apparatus 1 with reference to FIG. 7, which shows a block diagram of the control system. Such control system may include a main controller 501 and a print controller 502, for example. The main controller 501 may include a microcomputer to control the image forming apparatus 1 as a whole. The print controller 502 may include another microcomputer to control a printing process. Further, the main controller 501 may include functions such as detecting gas bubble intrusion to the sub-tank 35; determining ink end condition; setting a dispensable ink volume, which is variably set depending on flags indicating gas intrusion, or the like, but not limited thereto.

The control system receives image data from an information processing unit 400 via a communication circuit 500. The information processing unit 400 may include an application 401, an OS 402, and a print driver 403, for example. As for the information processing unit 400, when a print command is issued by a user using the application 401, the OS 402 (e.g., GDI: Graphic Device Interface) transmits image data to the print driver 403, wherein such image data may be output by the image forming apparatus 1. The print driver 403 converts the image data, transmitted from the application 401, to printable image data, which can be processed by the image forming apparatus 1, and then input the printable image data to the image forming apparatus 1 via the communication circuit 500.

The main controller 501 receives the printable image data via the communication circuit 500, and controls an image forming operation on the sheet 42 based on the printable image data. Specifically, the main controller 501 controls a main scanning motor 531 and a sub-scanning motor 532 via a main scanning motor drive circuit 503 and a sub-scanning motor drive circuit 504, respectively. The main controller 501 controls the main scanning motor 531 used for moving the carriage 33 in a main scanning direction, and the sub-scanning motor 532 used for rotating the transport roller 52. Father, the main controller 501 controls a process of transmitting printable data to the print controller 502.

The main controller 501 is input with a detection signal from a carriage position detection circuit 505, which detects a position of the carriage 33. The main controller 501 controls a position of the carriage 33 and a moving speed of the carriage 33 based on the detection signal.

The carriage position detection circuit 505 detects a position of the carriage 33 using the encoder sensor 331 and the encoder scale 332. As above-described, the encoder scale 332 composed of a number of slits is disposed in a scanning direction of the carriage 33, and the encoder sensor 331 disposed on the carriage 33 reads the number of slits, and then carriage position detection circuit 505 counts the number of slits to detect a position of the carriage 33.

The main scanning motor drive circuit 503 is input with a carriage moving distance information from the main controller 501, and based on the carriage moving distance information, the main scanning motor drive circuit 503 drives the main scanning motor 531, by which the carriage 33 can be moved to a given position with a given speed.

Further, the main controller 501 is input with a detection signal of a transported-distance detection circuit 506, which detects a moving distance of the transport belt 51, and based on the detection signal of the transported-distance detection circuit 506, the main controller 501 controls a moving distance and moving speed of the transport belt 51.

The transported-distance detection circuit 506 detects a transported distance of the transport belt 51 by using the encoder sensor 331 and an encoder sheet attached on a rotation shaft of the transport roller 52, for example. The encoder sheet includes a number of slits, and the encoder sensor 331 reads the number of slits, and then transported-distance detection circuit 506 counts the number of slits to determine the transported distance of the transport belt 51.

The sub-scanning motor drive circuit 504 is input with a transported distance information from the main controller 501, and based on the transported distance information, the sub-scanning motor drive circuit 504 drives the sub-scanning motor 532 to rotate the transport roller 52, by which the transport belt 51 can be moved to a given position with a given speed.

The main controller 501 transmits a sheet-feed roller drive command to a sheet-feed roller drive circuit to rotate the sheet feed roller 43 for one rotation. The main controller 501 transmits a drive command to a refreshing unit drive circuit 511 to rotate a refreshing unit motor 533, by which the cap 82 can be moved in an upward and downward direction, and the wiper blade 83 can be moved in an upward and downward direction, for example.

The main controller 501 controls an ink-supply drive circuit 512 to drive the supply pump 241 of the supply pump unit 24, by which ink can be supplied from the ink cartridge 10 to the sub-tank 35.

The main controller 501 is input with various detection signals from sensors 520. Such detection signals transmitted from the sensors 520 may be a detection signal from the electrode pins 208*a* and 208*b*, which can used to detect the ink-filled condition of the sub-tank 35; a detection signal from the filler detection sensor 301; and a detection signal from a temperature sensor for detecting temperature near the sub-tank 35, but not limited these.

Further, the main controller 501 controls a cartridge communication circuit 515 to read and acquire information stored in a non-volatile memory 516 disposed for the ink cartridge 10 as a memory device. Then, the cartridge communication circuit 515 conducts a given process to the information, and then the information may be stored in a non-volatile memory 514, disposed for the image forming apparatus 1 as a memory device. The main controller 501 may use the non-volatile memory 514 to store history data of gas bubble intrusion (e.g., air intrusion history flag) in the sub-tank 35 when a gas bubble intrusion is detected. The non-volatile memory 516 and non-volatile memory 514 may be an electrically erasable programmable read-only memory (EEPROM), for example, but not limited thereto.

The print controller 502 receives signals from the main controller 501, the carriage position detection circuit 505, the transported-distance detection circuit 506, or the like, wherein the carriage position detection circuit 505 transmits carriage position information, and the transported-distance detection circuit 506 transmits transported distance information. Based on such information, the print controller 502 generates data to drive a pressure generation device for the recording head 34, and transmits such data to a head drive circuit 510. The pressure generation device is used to jet liquid droplets from the recording head 34.

Based on print data input from the print controller 502, the head drive circuit 510 drives the pressure generation device of the recording head 34 to jet liquid droplets from nozzles. The recording head 34 and pressure generation device may be a piezoelectric head and a piezoelectric element, for example, but not limited thereto.

A description is now given to a processing of ink end condition of the ink cartridge 10 when air (or gas bubble) is intruded in the ink supply system. The ink supply system of the image forming apparatus 1 is used to supply or fill ink into the sub-tank 35. If the sub-tank 35 does not become the ink-filled condition even if the supply pump 241 is activated for a given time or more (i.e., elapsing of given time), it is determined that the ink cartridge 10 becomes the ink end condition (i.e., ink is empty), and then a given process is conducted afterward.

When the ink bag 102 becomes an empty condition, nothing cannot be sucked out from ink bag 102. If the supply pump 241 is continuously driven under such empty condition of the ink bag 102, the internal pressure in the supply pump 241 may become a negative pressure, and such negative pressure may increase as the supply pump 241 is driven for an extended time. Accordingly, when a replacement instruction of the ink cartridge 10 is issued (or displayed), the internal pressure in the supply pump 241 may be set to the negative pressure strongly.

The ink cartridge 10 can be replaced with a new one by disengaging the hollow member 246 of the supply pump 241 from the rubber cover of the ink supply mouth 103. When the hollow member 246 is removed from the rubber cover, sucking of air into the supply pump 241 starts to occur because the supply pump 241 is in a negative pressure condition as above described. Once the air is sucked, the sucked air may not escape from the ink supply system because an ink supply route from the supply pump 241 to the sub-tank 35 is a closed route. Accordingly, when the ink cartridge 10 is replaced with a new one, and an ink supply operation is started, the sucked air is transported to the sub-tank 35 through the supply tube 36. Accordingly, when a replacement of the ink cartridge 10 is detected (i.e., removing of ink cartridge 10), it can be determined that air has intruded in the ink supply route.

Figure 8:
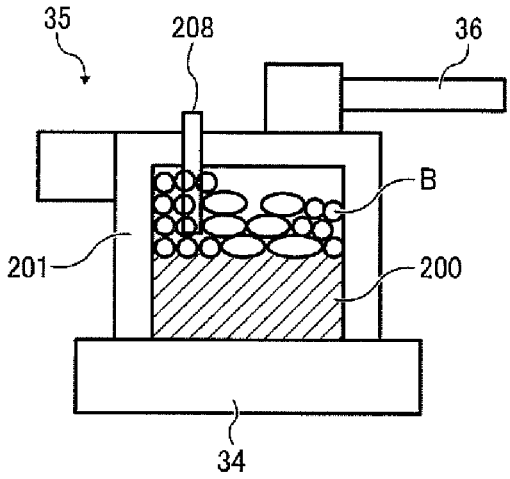
FIG. 8 illustrates a schematic view of gas bubble in a sub-tank.

When the sucked air is transported to the sub-tank 35, the air becomes a gas bubble B at ink surface of ink 200 in the sub-tank 35 as shown in FIG. 8. Such gas bubble B may further increase as the ink supply operation continues. The gas bubble B may mean one bubble or a number of gas bubbles occurring in the sub-tank 35 in this specification. Typically, the gas bubble B may be air bubble, but the gas may not be limited to air depending on environmental conditions of the image forming apparatus 1. In this specification, the term of gas may indicate air, but not limited thereto, and further gas and air may be used interchangeably.

Such gas bubble B in the sub-tank 35 may cause a detection failure of the electrode pins 208*a* and 208*b*. For example, if an ink filling operation is conducted for the sub-tank 35 having the intruded gas bubble B (see FIG. 8) under a condition that the internal space of the sub-tank 35 is communicated to atmosphere by opening the atmosphere-communicable unit 207, an ink-filled condition may not be correctly detected even if the sub-tank 35 is actually filled with ink. For example, the ink-filled condition may be detected by the electrode pins 208*a* and 208*b* at a timing, which is delayed from an actually ink filled condition. Such detection failure may occur because the intruded gas bubble B may accumulate around the electrode pins 208*a* and 208*b*, and thereby ink may not exist between the electrode pins 208*a* and 208*b* even if ink is substantially filled in the sub-tank 35. If such situation may occur, ink may spill over from the atmosphere-communicable unit 207 to the outside, by which the recording head 34 may be contaminated, and operational failures may occur on the recording head 34.

Figure 9:
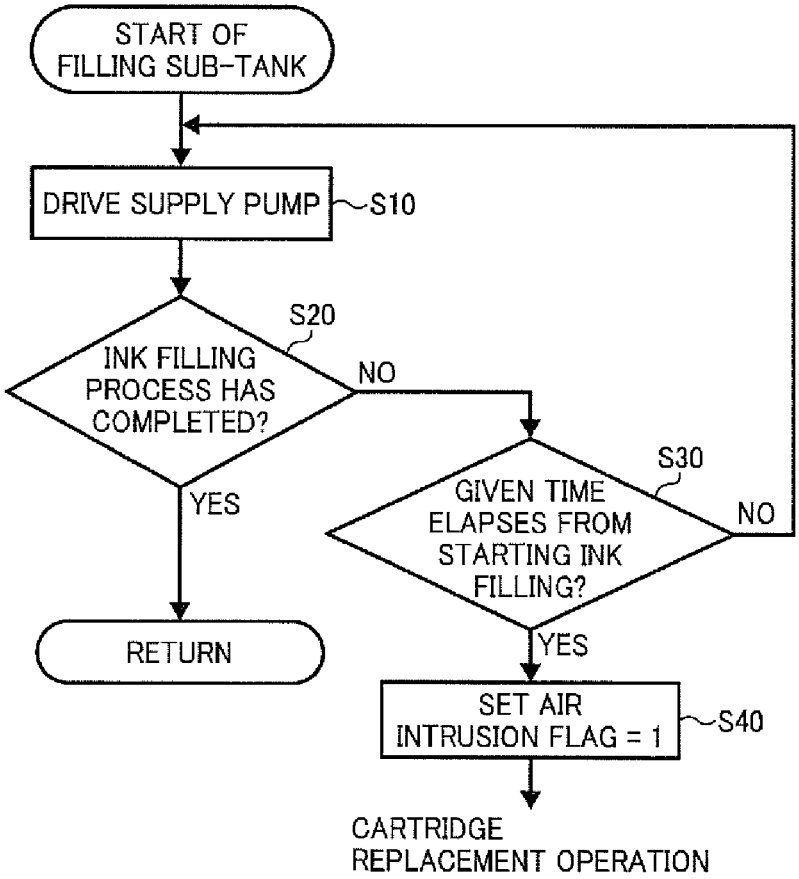
FIG. 9 is a flow chart for a process of setting an air intrusion flag when air intrusion is determined to occur at higher probability in a supply route.

A description is now given to a process when it is determined that air intrusion occurs in the ink supply route at higher probability with reference to FIG. 9, in which air exists in the ink supply route for the sub-tank 35. As for the image forming apparatus 1, if it is determined that air intrusion occurs at higher probability in the ink supply route for the sub-tank 35, an air intrusion flag is set to 1 (i.e., air intrusion flag=1).

Ink can be filled to the sub-tank 35 by driving the supply pump 241, in which ink can be supplied from the ink cartridge 10 to the sub-tank 35. Such ink filling process for the sub-tank 35 is conducted as shown in FIG. 9.

When an ink filling operation is started for the sub-tank 35, the supply pump 241 is driven at step S10.

At step S20, it is determined whether the ink filling process has completed. A completion of the ink filling process may be detected by using the electrode pins 208*a* and 208*b*, or the displacement member 205, for example. If it is determined that the ink filling process has not completed (No at step S20), the process goes to step S30.

At step S30, it is determined whether a given time elapses from a time of starting the ink filling process, wherein such elapsing of time may be referred to as "time out". If it is determined that the given time elapses (Yes at step S30), it is determined that the ink cartridge 10 is empty of ink, by which it is determined that air intrusion occurs at higher probability in the ink supply route. Then the process goes to step S40.

Such "time out" may be determined by using a detection result of the electrode pins 208*a* and 208*b*, or the displacement member 205. For example, if the detection result of the electrode pins 208*a* and 208*b*, or the displacement member 205 does not indicate the ink-filled condition when the given time elapses, it is determined that the "time out" occurs.

At step S40, the air intrusion flag is set to 1 (i.e., air intrusion flag=1), and then the process shifts to a cartridge replacement operation.

Figure 10:
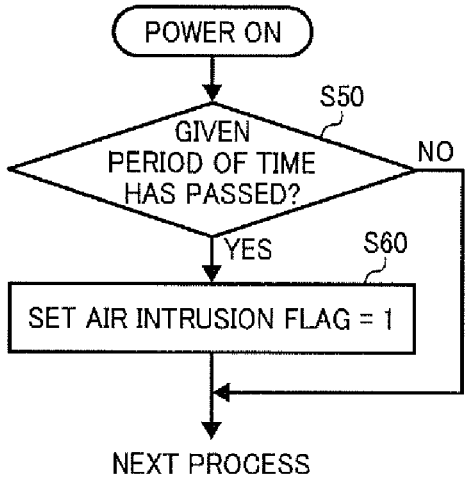
FIG. 10 is another flow chart for a process of setting an air intrusion flag when air intrusion is determined to occur at higher probability in a supply route.

A description is now given to another process of detecting air intrusion after supplying power to the image forming apparatus 1 with reference to FIG. 10. When the image forming apparatus 1 is set to a power ON condition by supplying power using a power source, at step S50, it is determined whether a given period of time has passed from a past given timing that the image forming apparatus 1 is set to a power OFF condition for the last time.

If it is determined that the given period of time has passed (e.g., 72 hours) from the last power OFF condition (Yes at step S50), it is determined that air intrusion occurs at higher probability in the ink supply route and the air intrusion flag is set to 1 (i.e., air intrusion flag=1) at step S60. Then, the process goes to given processes to be conducted after the power is set to ON condition.

The process shown in FIG. 10 may be typically conducted when the image forming apparatus 1 is not used for an extended period of time such as for example one month, six months, of the like, in which the supply pump 241 may not be driven. Although the ink supply route from the ink cartridge 10 to the sub-tank 35 is a closed route, air may gradually penetrate the ink supply route from the supply tube 36 because of material property of the tube 36, or air may gradually penetrate the ink supply route from a sealing portion of the supply pump 241.

As such, when the image forming apparatus 1 is not used for a given period of time set in advance, it is determined that air intrusion occurs at higher probability in the ink supply route such as in the supply pump 241 and the supply tube 36, and then the air intrusion flag is set to 1 (i.e., air intrusion flag=1).

Figure 11:
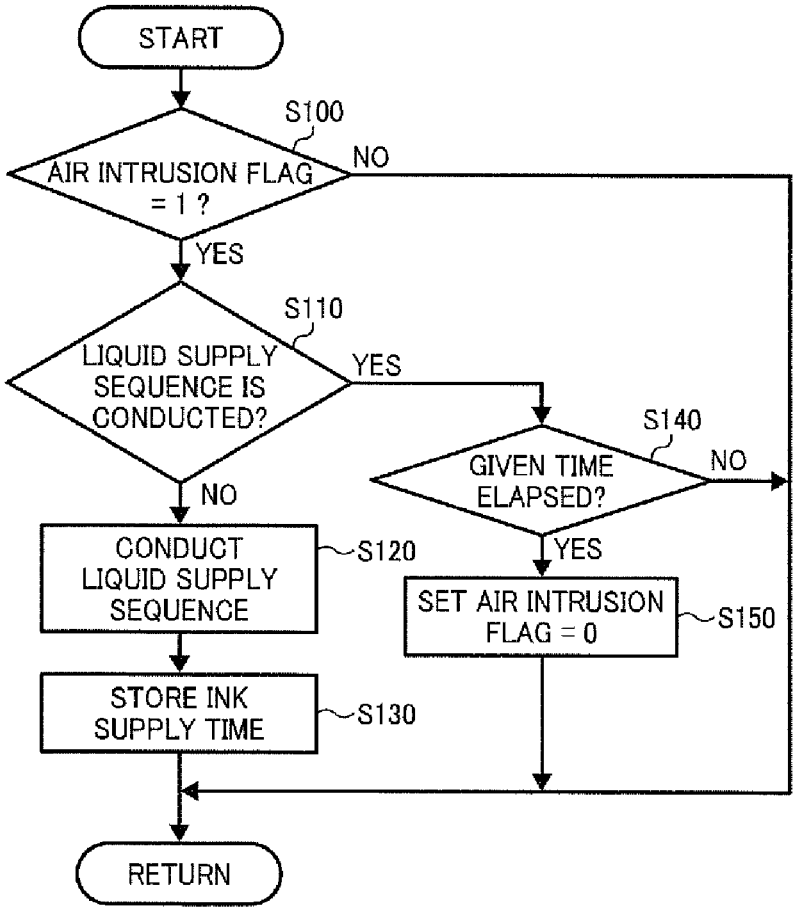
FIG. 11 is a flow chart for a process of ink supply operation when air intrusion is determined to occur at higher probability in a supply route.

A description is now given to a process of ink filling operation in view of the air intrusion flag with reference to FIG. 11. As shown in FIG. 11, at step S100, it is determined whether the air intrusion flag is set to "1" for the image forming apparatus 1, in which the air intrusion flag is checked for each one of heads, for example. Step S100 may be conducted by referring the non-volatile memory 514 or 516 because the air intrusion flag may be stored in the non-volatile memory 514 or 516.

At step S110, it is determined whether a liquid supply sequence is conducted for the image forming apparatus 1 by referring an ink supply time. The liquid supply sequence is an ink supply sequence that ink is supplied from the ink cartridge 10 to the sub-tank 35. If ink is supplied actually, an actual supply time of the liquid supply sequence is stored in the non-volatile memory 514 or 516, and such actual supply time is used to determine that the liquid supply sequence is conducted; if the liquid supply sequence is not conducted, a dummy time stored in the non-volatile memory is used to determine that the liquid supply sequence is not conducted.

If it is determined that the liquid supply sequence is not conducted (No at step S110), the liquid supply sequence is conducted at step S120 to transport intruded air with ink through the supply pump 241 and the supply tube 36 to the sub-tank 35, and then, the ink supply time to the sub-tank 35 is stored in a memory such as the non-volatile memory 514 or 516 at step S130. The ink supply time to the sub-tank 35 is a time when ink is supplied to the sub-tank 35, in which air may be transported with ink in some cases.

In the liquid supply sequence, ink may be supplied to the sub-tank 35 with a greater amount compared to a normal ink supply. The normal ink supply is conducted when ink is supplied to the sub-tank 35 under a normal supply condition. After the sub-tank 35 is filled with ink, the recording head 34 is capped by the cap 82 to conduct a nozzle suction operation to generate a negative pressure in the sub-tank 35. Then, the nozzle face of the recording head 34 is wiped by the wiper blade 83 for a given number of times (e.g., two to three times), the recording head 34 is cleaned by a cleaning process, and the recording head 34 is capped by the cap 82. The nozzle face includes nozzles to jet or dispense liquid droplet such as ink.

On one hand, if the air intrusion flag is "1" (Yes at S100) and the liquid supply sequence has already been conducted (Yes at S110), the process goes to step S140.

At step S140, it is determined whether a given time set for disappearing of gas bubble, transported in the sub-tank 35, elapses after the ink supply time at step S140. At step S140, the actual supply time of the liquid supply sequence stored in the non-volatile memory may be compared with a present time at step S140 to determine whether the given time elapses. If it is determined that the given time elapses (Yes at step S140), the air intrusion flag is reset to 0 (i.e., air intrusion flag=0) at step S150.

In the above described ink supply system, the ink near-end condition of the ink cartridge 10 may be detected by checking ink remaining amount information stored in the non-volatile memory 516 disposed for the ink cartridge 10. Specifically, the ink near-end condition of the ink cartridge 10 is determined by comparing ink remaining amount information stored in the non-volatile memory 516 with a given threshold ink volume. Accordingly, when the ink remaining amount information becomes the ink threshold volume or less, it is determined as the ink near-end condition.

A description is given to a computing of the ink consumption amount of the ink cartridge 10.

Typically, ink consumption amount is a total sum of a consumed ink amount by an ink discharge operation and a consumed ink amount by an ink sucking operation. The ink discharge operation is a dispensing operation of ink when an image forming operation is conducted; the ink sucking operation is a refreshing operation of the recording head 34, in which the ink is dispensed from the recording head 34 to refresh or maintain nozzle performance of the recording head 34. Such ink consumption amount can be mathematically computed using a given method set by an apparatus design.

The consumed ink amount by the ink discharge operation can be computed based on the number of signal-generated times and a signal strength of head drive signal that drives the recording head 34. Specifically, the signal strength of head drive signal is multiplied by the number of signal-generated times to compute ink amount jetted from the recording head 34 for one image forming operation, wherein such ink amount consumption computation is conducted for each one of image forming operations. Then the computed ink amount consumption for every one of the image forming operations are accumulated to compute the consumed ink amount by the ink discharge operation.

Further, the consumed ink amount by the ink sucking operation can be computed as below, wherein the ink sucking operation is conducted by the refreshing unit 81. The consumed ink amount by the ink sucking operation can be computed by multiplying an ink suction amount per one nozzle suction operation and the numbers of times of nozzle suction operation.

Accordingly, the ink consumption amount can be computed by adding the consumed ink amount by the ink discharge operation and the consumed ink amount by the ink sucking operation.

Accordingly, ink remaining amount in the ink cartridge 10 can be mathematically computed by subtracting the computed ink consumption amount from an initial ink supply volume supplied from the ink cartridge 10 to the sub-tank 35. Such ink remaining amount can be computed using the above described electronic counting method.

As such, the ink remaining amount can be computed based on the ink consumption amount computed by the electronic counting method. However, the ink consumption amount computed by the electronic counting method may deviate from an actual ink consumption. For example, the actual ink consumption may become too great than the ink consumption amount computed by the electronic counting method. If such discrepancy occurs, the ink cartridge 10 may become an ink end condition actually even if the ink near-end condition is not detected for the ink cartridge 10 by the electronic counting method. At such condition, ink cannot be sucked from the ink cartridge 10.

The ink near-end condition needs to be continued for a given period of time to secure a time for preparing and replacing the ink cartridge 10 with a new one. During the ink near-end condition, ink in the ink cartridge 10 may be almost consumed, but ink remaining in the sub-tank 35 can be still used for the image forming operation. Such remaining ink in the sub-tank 35 is further consumed during the ink near-end condition.

An ink end condition, which comes after the ink near-end condition, may be determined by checking ink amount consumed from the sub-tank 35 during the ink near-end condition. As above described, ink is consumed during the ink near-end condition, and when a given amount of ink is consumed from the sub-tank 35, the ink end condition occurs. Accordingly, such given amount of ink consumed from the sub-tank 35 during the ink near-end condition may be used as threshold ink volume to determine the ink end condition, and may be referred to as "dispensable ink volume" of the sub-tank 35. The "dispensable ink volume" may be set to a given value in view of air intrusion history flag, to be described later. When the ink end condition occurs, a replacement of ink cartridge 10 is to be conducted.

A description is now given to a movement of the flexible film 203 of the sub-tank 35. Typically, the flexible film 203 deforms or deflates its shape from the original shape (e.g., expanded shape) as ink is consumed from the sub-tank 35, and may regain or restore its original shape (e.g., expanded shape) by filling ink in the sub-tank 35. However, if ink consumption in the sub-tank 35 during the ink near-end condition becomes greater to extend a time period for the ink near-end condition, ink remaining amount in the sub-tank 35 becomes smaller compared to a normal ink remaining amount in the sub-tank 35, which is set as a default condition.

If the flexible film 203 deforms or deflates its shape too great, greater hysteresis remains on the flexible film 203. If the hysteresis of the flexible film 203 becomes too great, such hysteresis cannot be removed just by conducting a normal ink supply, and thereby the flexible film 203 cannot restore its shape. If the flexible film 203 cannot restore its shape, it cannot be determined whether ink can be supplied correctly to the sub-tank 35. The normal ink supply is a process to be conducted when ink is supplied from the ink cartridge 10 while sufficient ink is still stored in the ink cartridge 10.

The hysteresis of the flexible film 203 can be removed by opening the atmosphere-communicable unit 207 and communicating the sub-tank 35 to the atmosphere, and expanding the flexible film 203 completely using the atmosphere pressure. However, if the air intrusion flag is set to 1, the atmosphere-communicating operation cannot be conducted as below explained.

Specifically, if the atmosphere-communicating operation is conducted when the air intrusion flag is set to 1, an ink level in the sub-tank 35 may not be detected correctly due to the gas bubble intruded in the sub-tank 35. For example, even if an ink level detector (e.g., electrode pin 208) detects ink, actual ink amount in the sub-tank 35 may have already exceeded the designed ink capacity of the sub-tank 35 at such detection timing (i.e., ink detection timing is late). Such excessively supplied ink may spill over to the atmosphere-communicable unit 207, and cause operational malfunctions of the atmosphere-communicable unit 207 (e.g., air release path 207*a* cannot be closed). Such malfunctioned atmosphere-communicable unit 207 may hinder an effective negative pressure generation in the sub-tank 35.

A description is now given to example embodiments according to the present invention, in which the ink near-end condition is effectively extended. In the example embodiments, a dispensable ink volume of the sub-tank 35 is set in view of gas bubble intrusion in the sub-tank 35 (or air intrusion history flag), wherein the dispensable ink volume is used as a threshold ink volume in the sub-tank 35 to determine the ink end condition.

FIGS. 12A/12B to FIGS. 14A/14B shows a first example embodiment, in which the ink near-end condition is extended effectively by setting a dispensable ink volume of the sub-tank 35 depending on a value of air intrusion history flag.

When the ink cartridge 10 substantially becomes an empty condition (i.e., ink is substantially consumed from the ink cartridge 10), ink cannot be supplied from the ink cartridge 10 to the sub-tank 35. Under such condition, an image forming operation can be continued using ink still remaining in the sub-tank 35, wherein such condition may be referred to as an ink near-end condition.

As ink is dispensed from the recording head 34 under such ink near-end condition, ink in the sub-tank 35 is being consumed gradually. When a give amount of ink in the sub-tank 35 is consumed under the ink near-end condition, it is determined as the ink end condition, at which the image forming operation cannot be continued.

Specifically, a dispensable ink volume of the sub-tank 35 under the ink near-end condition can be variably set depending on a history flag of gas bubble intrusion. When the dispensable ink volume ink is consumed from the sub-tank 35, it is determined as ink end condition. The dispensable ink volume may be variably set depending on values of history flag of gas bubble intrusion, which may be stored in the non-volatile memory and read at a given timing to set a given dispensable ink volume.

In example embodiments, the history flag of gas bubble intrusion is set to 1 when it is determined that gas bubble intrusion still continues, and set to 0 when it is determined that gas bubble intrusion has disappeared. Hereinafter, the history flag of gas bubble intrusion set to 1 may be referred to as "air intrusion history flag=1" and the history flag of gas bubble intrusion set to 0 may be referred to as "air intrusion history flag=0."

The dispensable ink volume of the sub-tank 35 may be variably set to a given value for "air intrusion history flag=1" and "air intrusion history flag=0," respectively. In example embodiments, the dispensable ink volume set for "air intrusion history flag=1" may be referred to as a first dispensable ink volume, and the dispensable ink volume set for "air intrusion history flag=0" may be referred to as a second dispensable ink volume. Accordingly, the ink end condition of the sub-tank 35 can be determined by comparing an ink consumption amount (or ink remaining amount) in the sub-tank 35 during the ink near-end condition and the above-described first and second dispensable ink volume of the sub-tank 35.

Figure 12B:
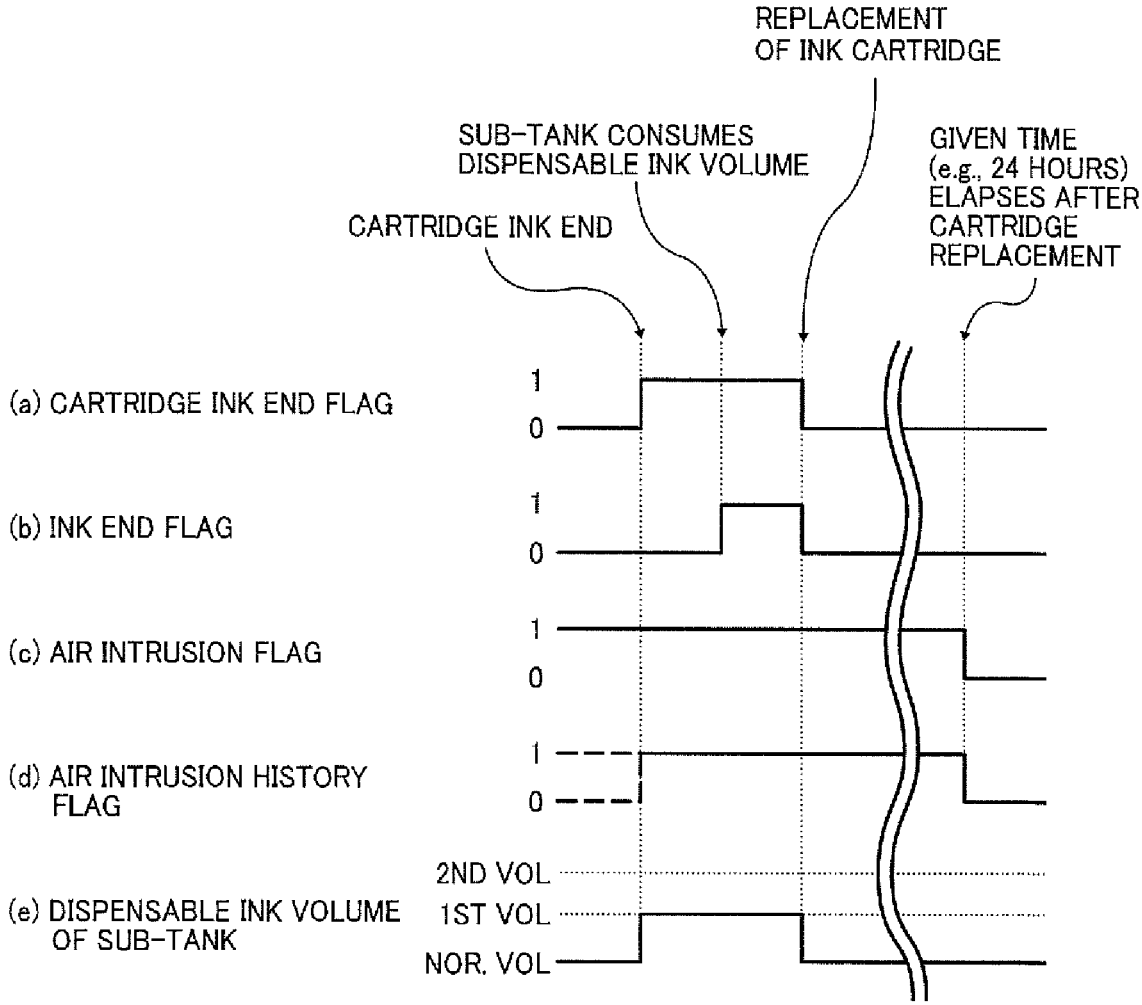
FIG. 12B is a timing chart of cartridge replacement of FIG. 12A.

A description is now given to one process when the air intrusion flag is set to 1 with reference to FIGS. 12A and 12B. FIG. 12A shows a cartridge replacement sequence chart when the air intrusion flag is set to 1 (i.e., air intrusion flag=1), and FIG. 12B shows a timing chart of FIG. 12A. The terms in the chart indicate following meaning.

A "cartridge ink end flag" is set to 1 when the ink cartridge 10 becomes the ink end condition, at which ink cannot be supplied from the ink cartridge 10.

An "ink end flag" is set to 1 when an image forming operation using ink remaining in the sub-tank 35 cannot be continued. Accordingly, "ink end flag=1" indicates a need of replacement of ink cartridge 10.

An "air intrusion flag" is set to 1 when it is determined that a gas bubble intrudes in the sub-tank 35. The air intrusion flag can be reset to 0 when it is determined that a gas bubble disappears from the sub-tank 35.

An "air intrusion history flag" is set to 1 when history data stores the air intrusion flag=1. Specifically, when "air intrusion history flag=1" is set, it is determined that air has not yet disappeared.

A "dispensable ink volume of sub-tank" is an ink volume used to determine the ink end condition for the image forming apparatus 1. When it is determined that the ink near-end condition occurs, an image forming operation can be continued using ink still remaining in the sub-tank 35. When the dispensable ink volume is consumed from the sub-tank 35, it is determined that the image forming operation cannot be continued. As such, the "dispensable ink volume" is a threshold ink volume of sub-tank 35 to determine whether the ink end condition occurs. The dispensable ink volume may be set in advance.

FIG. 12A shows a cartridge replacement sequence chart when the air intrusion flag is set to 1 (i.e., air intrusion flag=1). When an image forming operation is conducted (sequence 1 in FIG. 12A), ink is being supplied from the ink cartridge 10 to the sub-tank 35. As the image forming operation is being conducted, ink is being sucked from the ink cartridge 10, and resultantly, the cartridge ink end condition occurs to the ink cartridge 10 (sequence 2 in FIG. 12A). At sequence 2, the cartridge ink end condition is set (i.e., cartridge ink end flag is changed from 0 to 1: 0→1), and then the "air intrusion flag" is copied to the "air intrusion history flag" (see an arrow in FIG. 12A). Because the air intrusion flag=1 is detected (i.e., air intrusion flag=1), the air intrusion history flag is copied with 1 (i.e., air intrusion history flag=1).

As above described, if the "air intrusion history flag=1" is detected (e.g., read from a non-volatile memory), an atmosphere-communicating operation cannot be conducted for the sub-tank 35 after replacing the ink cartridge 10 with a new one. If it is determined that the atmosphere-communicating operation cannot be conducted, the dispensable ink volume of sub-tank 35 is set to the first dispensable ink volume corresponding the air intrusion history flag=1, in which the first dispensable ink volume may be set to a "smaller volume." As above described, the ink end condition is determined by referring the dispensable ink volume selectively set for the sub-tank 35. At sequence 2, the ink near-end condition is notified to a given unit (e.g., displayed on a display screen) to facilitate a replacement of the ink cartridge 10 in a timely manner.

Figure 13:
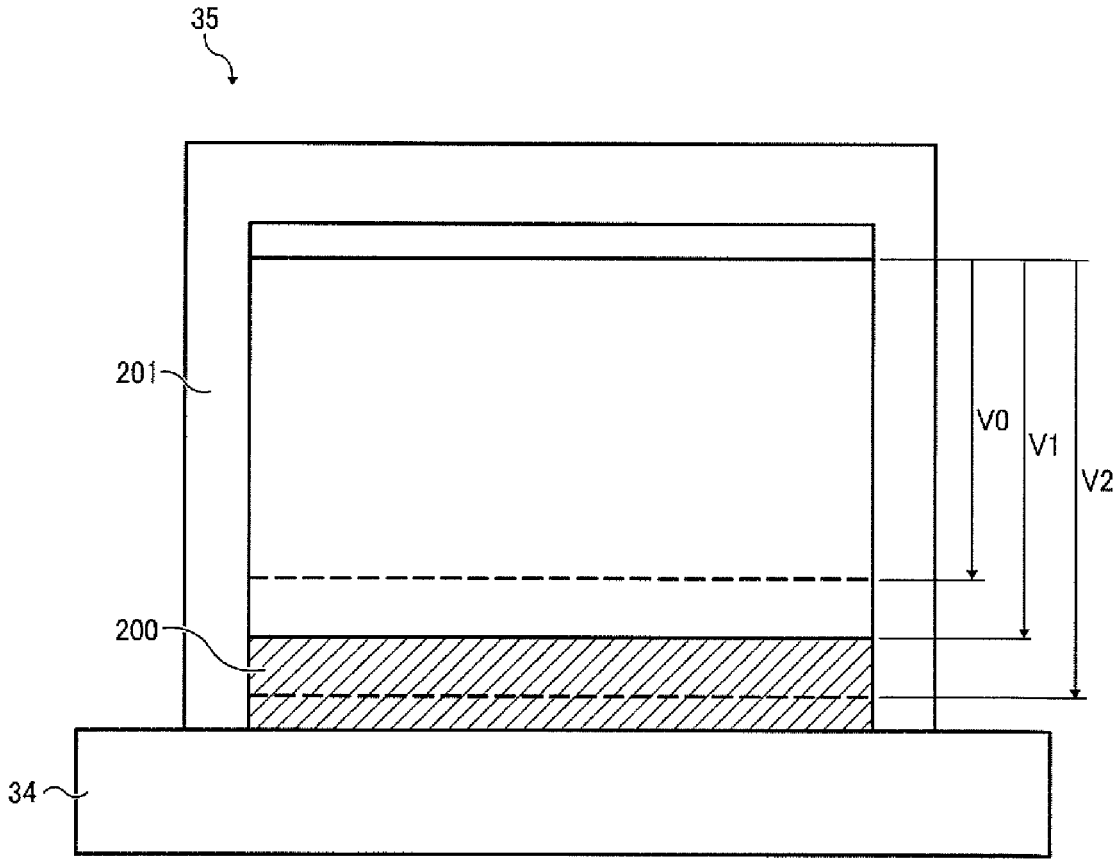
FIG. 13 shows a relationship of dispensable ink volume for a sub-tank for FIG. 12, in which a first dispensable ink volume is consumed.

As the image forming operation is still being continued using ink remaining in the sub-tank 35, the first dispensable ink volume may be consumed from the sub-tank 35 (sequence 3 in FIG. 12A), by which it is determined that the ink end condition occurs, and the sequence 4 is to be conducted, in which the ink cartridge 10 is replaced with a new one. FIG. 13 schematically shows the first dispensable ink volume in the sub-tank 35.

When the ink cartridge 10 is replaced with the new one (sequence 4 in FIG. 12A), the cartridge ink end flag and the ink end flag are reset to 0, and the first dispensable ink volume may be reset to a normal dispensable ink volume (sequence 4 in FIG. 12A). The normal dispensable ink volume is a threshold ink volume for the sub-tank 35, which is used to determine an ink supply timing to the sub-tank 35 when ink is supplied under a normal supply process. After such cartridge replacement operation, a liquid supply sequence is to be conducted to supply ink from the ink cartridge 10 to the sub-tank 35.

Further, if a given time (e.g., 24 hours) set in advance elapses after the above-described cartridge replacement operation, it is determined that the intruded air has disappeared from the sub-tank 35, and then the air intrusion flag and the air intrusion history flag is reset to 0 (sequence 5 in FIG. 12A).

Figure 14B:
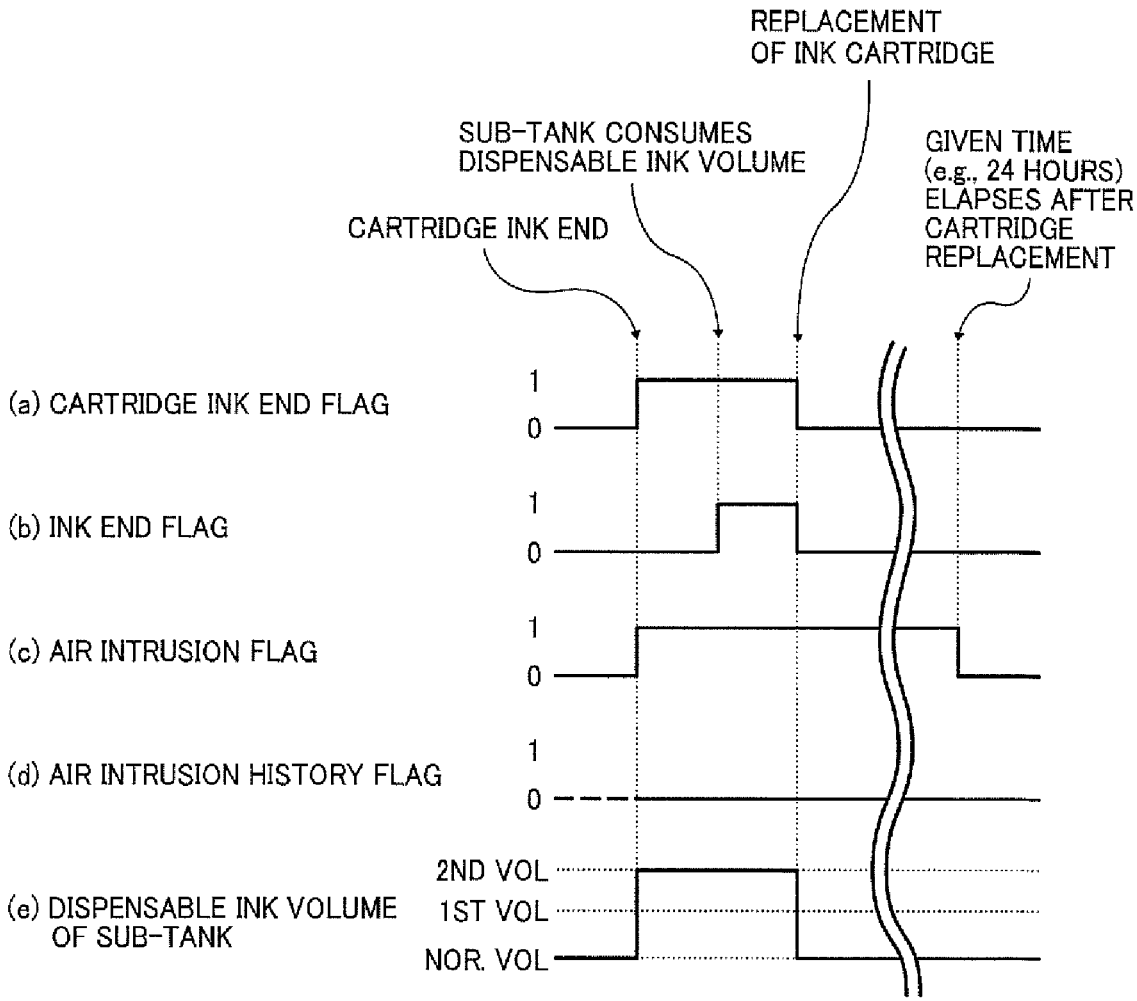
FIG. 14B is a timing chart of cartridge replacement of FIG. 14A.

A description is now given to another process when the air intrusion flag is set to 0 with reference to FIGS. 14A and 14B. FIG. 14A shows a cartridge replacement sequence chart when the air intrusion flag is set to 0 (i.e., air intrusion flag=0), and FIG. 14B shows a timing chart of FIG. 14A. When an image forming operation is conducted (sequence 1 in FIG. 14A), ink is being supplied from the ink cartridge 10 to the sub-tank 35. As the image forming operation is being conducted, ink is being sucked from the ink cartridge 10, and resultantly, the cartridge ink end condition occurs to the ink cartridge 10 (sequence 2 in FIG. 14A). At sequence 2, the cartridge ink end condition is set (i.e., cartridge ink end flag is changed from 0 to 1: 0→1), and then the "air intrusion flag" is copied to the "air intrusion history flag" (see an arrow in FIG. 14A). Because the air intrusion flag is set to 0 (i.e., air intrusion flag=0), the air intrusion history flag" is copied with 0 (i.e., air intrusion history flag=1). Then, the air intrusion flag is set to 1 at sequence 2.

As above described, if the "air intrusion history flag=0" is detected (e.g., read from a non-volatile memory), an atmosphere-communicating operation can be conducted for the sub-tank 35 after replacing the ink cartridge 10 with a new one.

If it is determined that the atmosphere-communicating operation can be conducted, the dispensable ink volume of sub-tank 35 is set to the second dispensable ink volume corresponding the air intrusion history flag=0, in which the second dispensable ink volume may be set to a "larger volume." The sequence 3, 4, and 5 in FIG. 14A are conducted as similar to when the air intrusion flag is set to 1 (i.e., air intrusion flag=1) shown in FIG. 12A.

As above described with reference to FIGS. 12A/12B to FIGS. 14A/14B, the dispensable ink volume of sub-tank 35 can be selectively set depending on the air intrusion history flag. Specifically, the first dispensable ink volume is set for the air intrusion history flag=1, and the second dispensable ink volume is set for the air intrusion history flag=0.

While the ink cartridge 10 still stores sufficient ink during an image forming operation, ink can be supplied to the sub-tank 35 from the ink cartridge 10 at a given timing when an ink amount in the sub-tank 35 is reduced to a given threshold amount, wherein such given threshold amount may be referred to as "normal dispensable ink volume V0." Accordingly, during a normal ink supply operation, ink is supplied to the sub-tank 35 when the normal dispensable ink volume is detected for the sub-tank 35.

Figure 15:
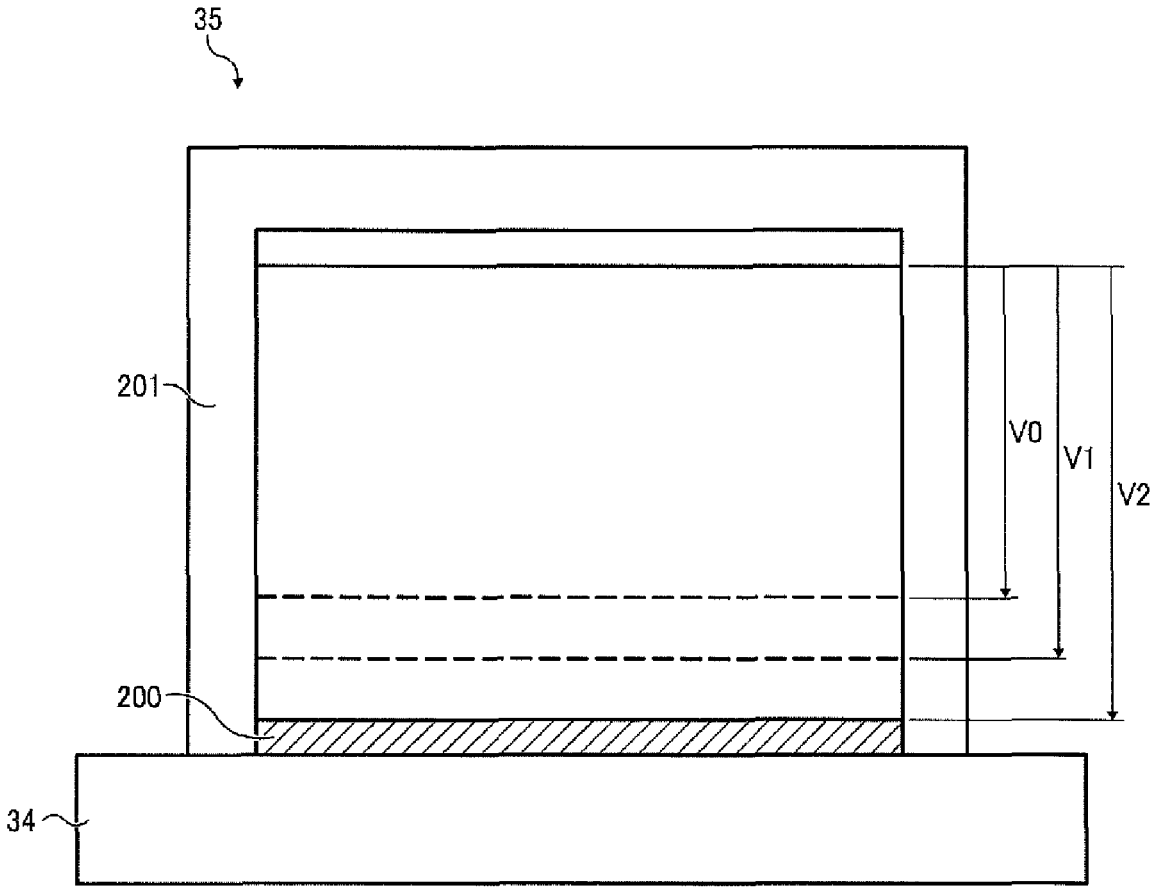
FIG. 15 shows a relation ship of dispensable ink volume for a sub-tank for FIG. 14, in which second first dispensable ink volume is consumed.

A relationship of the above described normal dispensable ink volume V0, first dispensable ink volume V1, and second dispensable ink volume V2 can be defined as "normal dispensable ink volume V0<first dispensable ink volume V1<second dispensable ink volume V2," which means the first dispensable ink volume V1 is set greater than the normal dispensable ink volume V0, and the second dispensable ink volume V2 is set greater than the first dispensable ink volume V1 as shown in FIGS. 12B, 14B, 13, and 15. FIGS. 13 and 15 schematically show such relationship of the dispensable ink volume set for the sub-tank 35. FIG. 13 shows a case that the first dispensable ink volume is consumed from the sub-tank 35, and FIG. 15 shows a case that the second dispensable ink volume is consumed from the sub-tank 3. Although, FIGS. 13 and 15 show a level of the normal dispensable ink volume V0, first dispensable ink volume V1, and second dispensable ink volume V2, each of the normal dispensable ink volume V0, first dispensable ink volume V1, and second dispensable ink volume V2 can be set to a given value while maintaining the relationship of "normal dispensable ink volume V0<first dispensable ink volume V1<second dispensable ink volume V2."

The first dispensable ink volume (smaller amount) may be set to a given value that does not cause hysteresis on the flexible film 203. The second dispensable ink volume (larger amount) is set to another given value that may cause hysteresis on the flexible film 203. Although it is known that hysteresis occurs on the flexible film 203 when the flexible film 203 is deformed or deflated too much, a threshold value that causes the hysteresis may vary depending on several conditions such as for example environmental conditions, material property of flexible film, or the like.

In the above-described example embodiment, it can be determined whether gas bubble intrudes in the sub-tank 35; when the gas bubble intrusion is determined, an air intrusion history flag=1 is stored in a memory, for example; an ink end condition is detected when the dispensable ink volume is consumed from the sub-tank 35 under a condition that ink supply from the main tank to the sub-tank is unable to continue. The dispensable ink volume can be variably set depending on values of the air intrusion history flag. With such a configuration, an operational failures caused by hysteresis of the flexible member 203 can be prevented, and the ink near-end condition can be effectively extended.

In the above-described example embodiment, it is determined that gas bubble has disappeared from the sub-tank 35 when a given time period has elapsed (e.g., 24 hours). Such gas disappearing time period can be set to any value as long as such time period is assumed to be enough for gas disappearance. Such time period may be set in view of environmental conditions such as temperature, humidity, ink property, or the like.

Further, in cases of FIGS. 12 and 14, when the air intrusion flag is set to 1 (i.e., it is determined that gas bubble exists in the sub-tank 35), it is preferable not to allow the atmosphere-communicating operation of the atmosphere-communicable unit 207 of the sub-tank 35. With such a configuration, the ink near-end condition can be extended, and spillover of gas bubble from the atmosphere-communicable unit 207 can be prevented because the atmosphere-communicating operation is not conducted when gas bubble exists in the sub-tank 35. Accordingly, operational malfunctions of the atmosphere-communicable unit 207 caused by gas bubble can be prevented.

Figure 16:
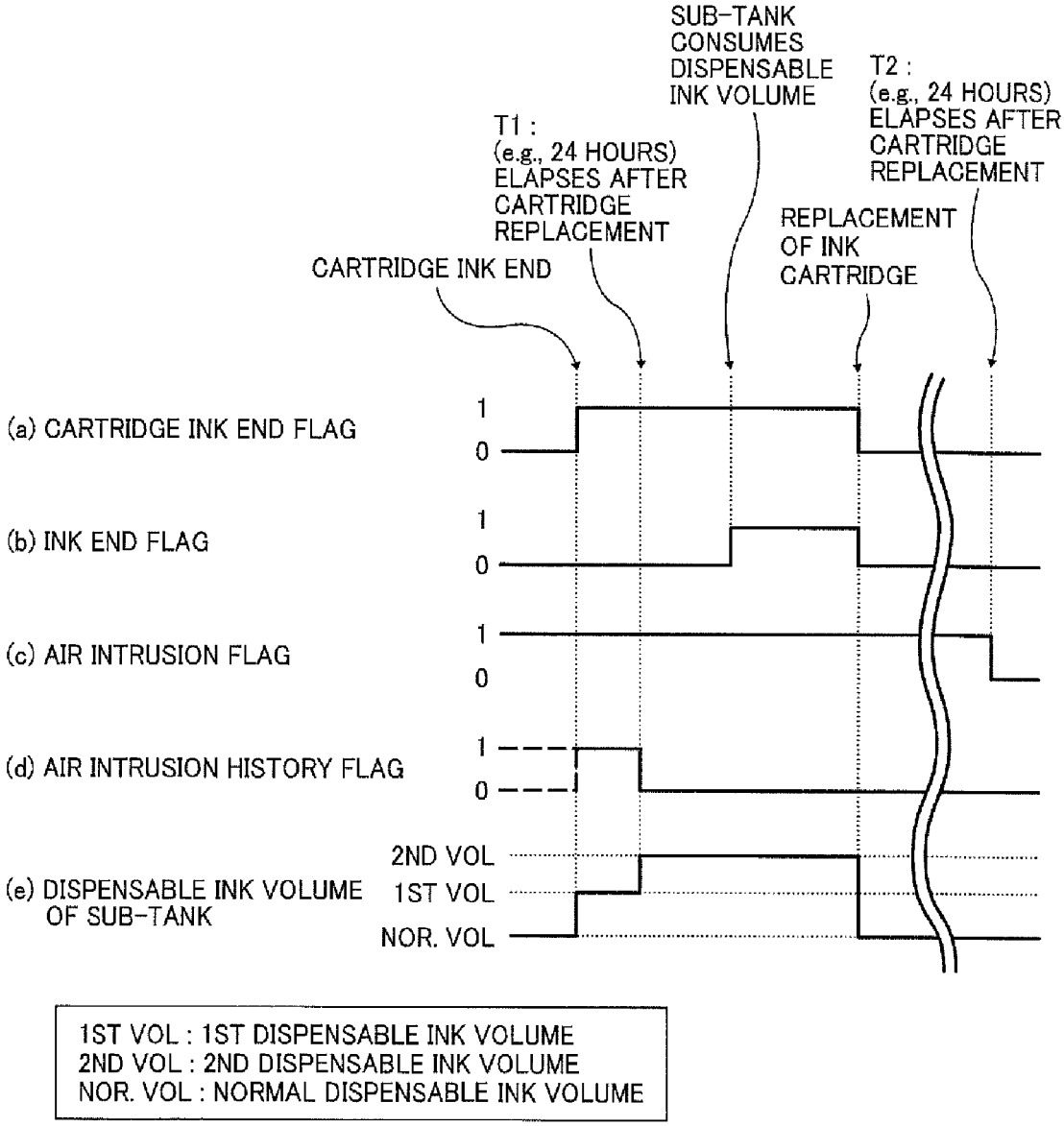
FIG. 16 is a timing chart of cartridge replacement according to second example embodiment.

A description is now given to a second example embodiment with reference to FIG. 16. FIG. 16 shows a timing chart when the air intrusion flag is set to 1 (i.e., air intrusion flag=1). FIG. 16 shows one example process that the ink cartridge 10 is replaced with a new one, an image forming operation is conducted using the ink cartridge 10, and then the ink cartridge 10 becomes the cartridge ink end condition again before a given time T1 (e.g., 24 hours) elapses after replacing the ink cartridge 10 with the new one. Accordingly, when the cartridge ink end condition is detected, it is determined that the sub-tank 35 still has gas bubble, and thereby the air intrusion history flag=1 is still set. Such situation may occur when the replaced new ink cartridge 10 is used for image forming operation producing a larger volume of printings, for example.

However, when the given time T1 (e.g., 24 hours) has come after the ink end condition occurs to the ink cartridge 10, it can be assumed that gas bubble has disappeared from the sub-tank 35, and thereby the air intrusion history flag can be reset to 0 (i.e., air intrusion history flag=0) at the given time T1.

As such, when the air intrusion history flag is reset to 0, the dispensable ink volume in the sub-tank 35 can be switched from the first dispensable ink volume (smaller amount) to the second dispensable ink volume (larger amount) as shown in FIG. 16. As such, the dispensable ink volume of the sub-tank 35 can be set to a preferable level in view of the air intrusion flag or air intrusion history flag indicating gas bubble intrusion, by which the ink near-end condition can be extended effectively in view of the gas bubble intrusion or non-intrusion in the sub-tank 35.

Figure 17:
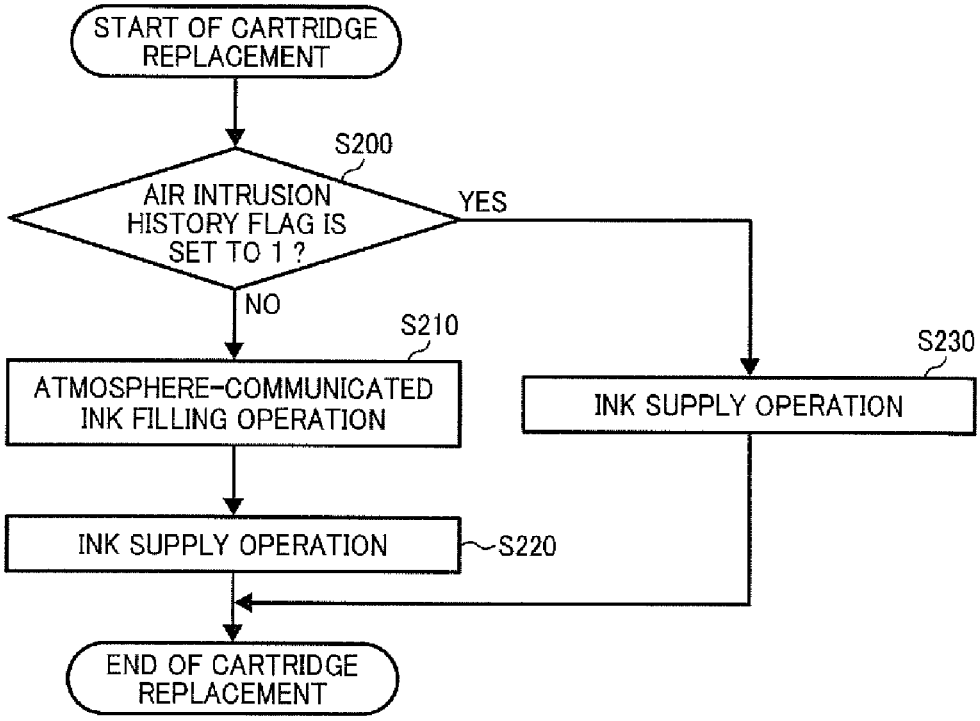
FIG. 17 is a flow chart for an ink supply operation after replacing a cartridge.

A description is now given to an ink supply process to be conducted for the sub-tank 35 when the ink cartridge 10 is replaced with a new one with reference to FIG. 17.

If the air intrusion history flag=0 is detected before the ink cartridge 10 is replaced with a new one, it can be assumed that gas bubble does not intrude the sub-tank 35 and the supply tube 36. In such a case, ink existing in the supply tube 36 can be supplied to the sub-tank 35 to fill the sub-tank 35 while setting an atmosphere-communicated condition using the atmosphere-communicable unit 207, wherein such ink filling process may be termed as ink filling operation under the atmosphere-communicated condition. As such, ink filling operation under the atmosphere-communicated condition can be conducted for one single time using ink existing in the supply tube 36. As such, ink filling using atmosphere-communicating operation can be conducted for one single time when the ink cartridge 10 is replaced with the new one.

As shown in FIG. 17, the ink cartridge 10 is replaced with a new one at the ink end condition. At step S200, it is determined whether the air intrusion history flag=1 is detected. If the air intrusion history flag=0 is detected (No at step S200), the ink filling operation under the atmosphere-communicated condition is conducted at step S210, and then the ink supply operation is conducted at step S220. On one hand, if the air intrusion history flag=1 is detected (Yes at step S200), the ink supply operation is conducted without conducting the ink filling operation under the atmosphere-communicated condition at step S230.

When the air intrusion history flag=0 is detected, the ink filling operation under the atmosphere-communicated condition can be conducted, by which hysteresis of the flexible film 203 of the sub-tank 35 can be removed effectively. As above described, when the air intrusion history flag=0 is detected and the ink near-end condition is set, ink can be dispensed from the recording head 34 using ink remaining in the sub-tank 35 until the second dispensable ink volume is dispensed from the recording head 34. Because the second dispensable ink volume is relatively greater, ink consumption in the sub-tank 35 becomes greater, by which the flexible film 203 deform or deflate greatly, and thereby hysteresis may occur on the flexible film 203. Accordingly, the ink filling operation under the atmosphere-communicating condition may be conducted for the sub-tank 35 to remove hysteresis of the flexible film 203 effectively.

Figure 18:
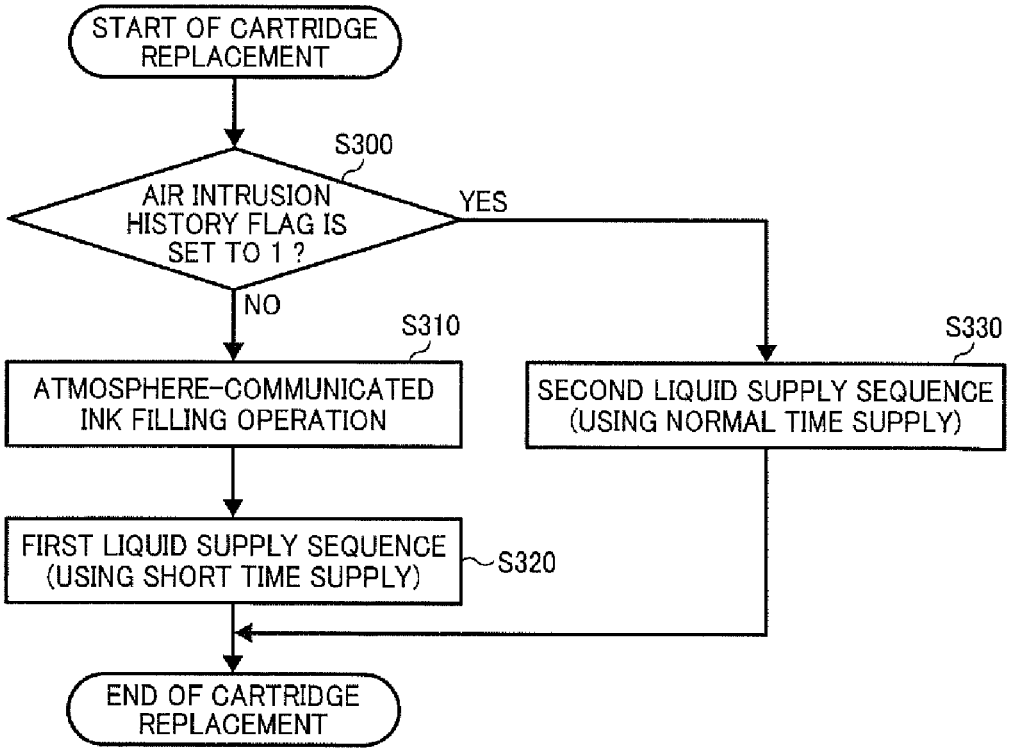
FIG. 18 is a flow chart for another ink supply operation after replacing a cartridge.

A description is now given to another ink supply process to be conducted when the ink cartridge 10 is replaced with a new one with reference to FIG. 18. When the ink cartridge 10 is replaced with a new one, a negative pressure occurs in the supply pump 241, by which gas bubble may intrude in the supply pump 241. As above described, if the intruded gas bubble is transported to the sub-tank 35 and the atmosphere-communicable unit 207 is activated to set the atmosphere-communicated condition, operational malfunctions may occur at least to the atmosphere-communicable unit 207. In general, gas bubble may hardly disappear from a tiny space such as ink supply route. However, if the gas bubble is transported to the sub-tank 35 having a relatively greater space, the gas bubble can disappear in a relatively shorter time.

As shown in FIG. 18, the ink cartridge 10 is replaced with a new one at the ink end condition. At step S300, it is determined whether the air intrusion history flag=1 is detected. If the air intrusion history flag=0 is detected (No at step S300), the ink filling operation under the atmosphere-communicated condition is conducted at first at step S310. Then, at step S320, a first liquid supply sequence is conducted to transport a first volume of ink to the sub-tank 35. In such process, a total volume of ink supply at steps S310 and S320 may be substantially equivalent to the internal volume of the ink supply route, and the gas bubble intruded in the ink supply route can be transported to the sub-tank 35 by the first liquid supply sequence. With such a configuration, gas bubble can be transported in the sub-tank 35, and can disappear from the sub-tank 35 with a relatively shorter time.

As such, when the air intrusion history flag=0 is detected, the ink filling operation under the atmosphere-communicated condition can be conducted at first, and then the first liquid supply sequence (using short time supply) is conducted.

On one hand, if the air intrusion history flag=1 is detected (Yes at S300), a second liquid supply sequence (using normal time supply) is conducted without conducting the ink filling operation under the atmosphere-communicated condition at step S330.

In such configuration, ink volume substantially corresponding to "internal volume in the ink supply route" is supplied to the sub-tank 35 by conducting the second liquid supply sequence (using with normal time supply) alone.

On one hand, ink volume substantially corresponding to "internal volume in the ink supply route" is supplied to the sub-tank 35 by conducting the "ink filling operation under the atmosphere-communicated condition" and the first liquid supply sequence (using short time supply)."

As such, ink volume supplied by the first liquid supply sequence (using short time supply) and the second liquid supply sequence (using with normal time supply) are differentiated, and thereby ink can be used effectively by reducing wasteful ink consumption.

A description is now given to a third example embodiment with reference to FIGS. 12 to 14. As shown in FIG. 12A/12B, when an image forming operation is conducted (sequence 1 in FIG. 12A), ink is being supplied from the ink cartridge 10 to the sub-tank 35. As the image forming operation is being conducted, ink is being sucked from the ink cartridge 10, and resultantly, the cartridge ink end condition occurs to the ink cartridge 10 (sequence 2 in FIG. 12A). At sequence 2, the cartridge ink end condition is set (i.e., cartridge ink end flag is changed from 0 to 1: 0→1), and then the "air intrusion flag" is copied to the "air intrusion history flag" (see an arrow in FIG. 12A). Because the air intrusion flag=1 is detected (i.e., air intrusion flag=1), the air intrusion history flag is copied with 1 (i.e., air intrusion history flag=1).

As above described, if the "air intrusion history flag=1" is detected (e.g., read from a non-volatile memory), an atmosphere-communicating operation cannot be conducted for the sub-tank 35 after replacing the ink cartridge 10 with a new one. If it is determined that the atmosphere-communicating operation cannot be conducted, the dispensable ink volume of sub-tank 35 is set to the first dispensable ink volume corresponding the air intrusion history flag=1, in which the first dispensable ink volume may be set to a "smaller volume." As above described, the ink end condition is determined by referring the dispensable ink volume selectively set for the sub-tank 35. At sequence 2, the ink near-end condition is notified to a given unit (e.g., displayed on a display screen) to facilitate a replacement of the ink cartridge 10 in a timely manner.

As the image forming operation is still being continued using ink remaining in the sub-tank 35, the first dispensable ink volume may be consumed from the sub-tank 35 (sequence 3 in FIG. 12A), by which it is determined that the ink end condition occurs, and the sequence 4 is to be conducted, in which the ink cartridge 10 is replaced with a new one.

When the ink cartridge 10 is replaced with a new one, the cartridge ink end flag and the ink end flag are reset to 0, and the first dispensable ink volume may be reset to a normal dispensable ink volume (sequence 4 in FIG. 12A). The normal dispensable ink volume is a threshold ink volume for the sub-tank 35, which is used to determine an ink supply timing to the sub-tank 35 when ink is supplied under a normal supply process. After such cartridge replacement operation, a liquid supply sequence is to be conducted to supply ink from the ink cartridge 10 to the sub-tank 35.

Further, if a given time (e.g., 24 hours) set in advance elapses after the above-described cartridge replacement operation, it is determined that the intruded air has disappeared from the sub-tank 35, and then the air intrusion flag and the air intrusion history flag is reset to 0 (sequence 5 in FIG. 12A).

Further, a description is given to one process when the air intrusion flag is set to 0 with reference to FIGS. 14A/14B. FIG. 14A shows a cartridge replacement sequence chart when the air intrusion flag is set to 0 (i.e., air intrusion flag=0), and FIG. 14B shows a timing chart of FIG. 14A.

When an image forming operation is conducted (sequence 1 in FIG. 14A), ink is being supplied from the ink cartridge 10 to the sub-tank 35. As the image forming operation is being conducted, ink is being sucked from the ink cartridge 10, and resultantly, the cartridge ink end condition occurs to the ink cartridge 10 (sequence 2 in FIG. 14A). At sequence 2, the cartridge ink end condition is set (i.e., cartridge ink end flag is changed from 0 to 1: 0→1), and then the "air intrusion flag" is copied to the "air intrusion history flag" (see an arrow in FIG. 14A). Because the air intrusion flag is set to 0 (i.e., air intrusion flag=0), the air intrusion history flag" is copied with 0 (i.e., air intrusion history flag=0). Then, the air intrusion flag is set to 1 at sequence 2.

As above described, if the "air intrusion history flag=0" is detected (e.g., read from a non-volatile memory), an atmosphere-communicating operation can be conducted for the sub-tank 35 after replacing the ink cartridge 10 with a new one.

If it is determined that the atmosphere-communicating operation can be conducted, the dispensable ink volume of sub-tank 35 is set to the second dispensable ink volume corresponding the air intrusion history flag=0, in which the second dispensable ink volume may be set to a "larger volume." At sequence 2, the ink near-end condition is notified to a given unit (e.g., displayed on a display screen) to facilitate a replacement of the ink cartridge 10 in a timely manner.

As the image forming operation is still being continued using ink remaining in the sub-tank 35, the second dispensable ink volume may be consumed from the sub-tank 35 (sequence 3 in FIG. 14A), by which it is determined that the ink end condition occurs, and the sequence 4 is to be conducted, in which the ink cartridge 10 is replaced with a new one.

When the ink cartridge 10 is replaced with the new one (sequence 4 in FIG. 14A), the cartridge ink end flag and the ink end flag are reset to 0, and the second dispensable ink volume may be reset to a normal dispensable ink volume (sequence 4 in FIG. 14A). The normal dispensable ink volume is a threshold ink volume for the sub-tank 35, which is used to determine an ink supply timing to the sub-tank 35 when ink is supplied under a normal supply process.

After such cartridge replacement operation, ink may be supplied to the sub-tank 35 by taking following steps as below: At first, a given amount of ink is preliminary supplied to the sub-tank 35 from the ink cartridge 10, in which the internal space of the sub-tank 35 is not communicated to atmosphere. Then, the ink filling operation under the atmosphere-communicated condition is conducted for the sub-tank 35 so that the flexible film 203 can be expanded to its inflated shape. Further, an ink supply process using the first liquid supply sequence (using short time supply) is conducted for the sub-tank 35. The subsequent processes are conducted as similar when the air intrusion flag is set to 1 (i.e., air intrusion flag=1).

As such, in the third example embodiment, when the air intrusion history flag=0 is detected, the ink cartridge 10 is replaced with a new one. Then, without conducting the atmosphere-communicating operation of the atmosphere-communicable unit 207, preliminary amount of ink is supplied from the ink cartridge 10 to the sub-tank 35 at first. Then, the atmosphere-communicable unit 207 is activated to set the atmosphere-communicated condition so that ink can be supplied to the sub-tank 35 under the atmosphere-communicated condition.

Figure 19:
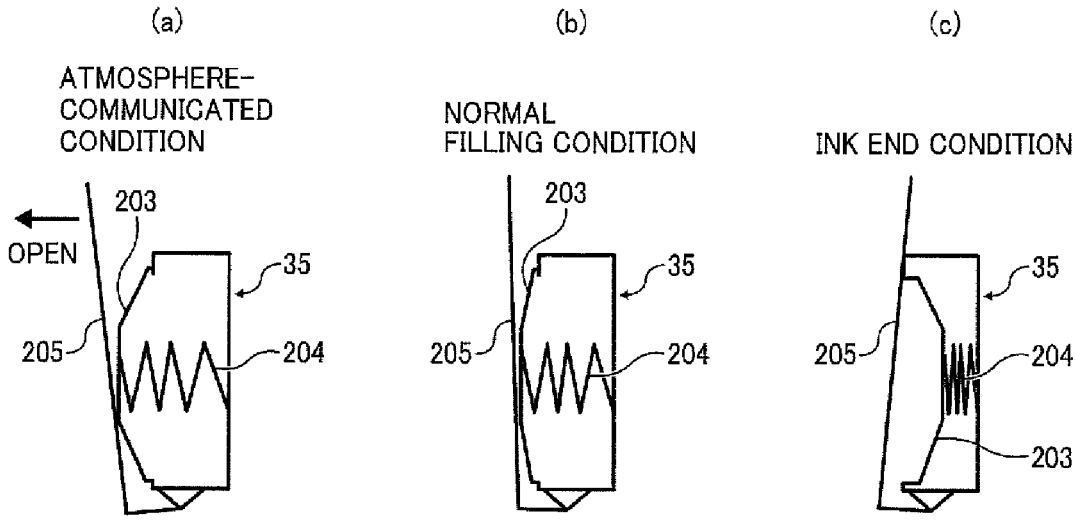
FIG. 19(*a*) illustrates a sub-tank in an atmosphere-communicated condition, FIG. 19(*b*) illustrates a sub-tank in a normally filled condition, and FIG. 19(*c*) illustrates a sub-tank in an ink end condition.

As such, after replacing the ink cartridge 10 with a new one, ink is supplied to the sub-tank 35 with following manner: preliminary ink supply without the atmosphere-communicated condition; ink supply under the atmosphere-communicated condition; and ink supply using the first liquid supply sequence (using short time supply). Such process may be conducted in view of effective ink filling operation for the sub-tank 35. As shown in FIG. 19, the sub-tank 35 may be set in various conditions: a) atmosphere-communicated condition; b) normally filled condition set by normal filling; and c) ink end condition.

FIG. 19(*a*) shows the sub-tank 35 under the atmosphere-communicated condition. When the atmosphere-communicable unit 207 of the sub-tank 35 is set to the atmosphere-communicated condition, the flexible film 203 can be expanded to outward using the biasing force of the spring 204 and atmosphere pressure as shown in FIG. 19(*a*), by which the displacement member 205 can be set to an opened condition.

FIG. 19(*b*) shows the sub-tank 35 under the normally filled condition. When the sub-tank 35 is filled with ink under the normal filling condition, a negative pressure can be generated in the sub-tank 35, in which the spring 204 applies the biasing force to the flexible film 203 to an outward direction.

FIG. 19(*c*) shows the sub-tank 35 in the ink end condition. When ink in the sub-tank 35 is consumed, the flexible film 203 is compressed toward the sub-tank 35 although the biasing force is applied by the spring 204. Accordingly, the flexible film 203 is more compressed toward the sub-tank 35 than the normally filled condition shown in FIG. 19(*b*).

In the above described example embodiments, the ink near-end condition can be extended for a given time. If the ink near-end condition is extended, ink is consumed with a greater amount, by which the flexible film 203 of the sub-tank 35 may deform or deflate greatly. In some case, the image forming apparatus 1 may be used under an environmental condition, which may not be preferable for image forming operation. Typically, low-temperature/low-humidity environment is not preferable for image forming operations using ink or the like. Accordingly, when an image forming operation is conducted under the ink near-end condition in a low-temperature/low-humidity environmental condition (e.g., 10° C. and 15%) while consuming greater amount of ink, the flexible film 203 may deflate too much. Such deflated flexible film 203 may not expand effectively even if ink is filled to the sub-tank 35 under the atmosphere-communicating condition. As shown in FIG. 19(*a*) and FIG. 19(*c*), if the flexible film 203 expands effectively, the flexible film 203 can change its shape from FIG. 19(*c*) to FIG. 19(*a*).

In view of such situation, preliminary amount of ink is supplied from the ink cartridge 10 to the sub-tank 35 without conducting the atmosphere-communicating operation at first. Such preliminary ink supply can be effective to move the flexible film 203, which means the hysteresis of the flexible film 203 can be removed effectively afterwards. Then, the ink filling operation under the atmosphere-communicated condition is effectively conducted for the sub-tank 35. As such, the flexible film 203 can be moved using an ink supply pressure during the above-described preliminary ink supply operation, and ink supply under the atmosphere-communicated condition.

As such, the flexible film 203 of the sub-tank 35 can be expanded effectively by supplying ink to the sub-tank 35 as above described after replacing the ink cartridge 10 with a new one. Accordingly, ink level detection failure, which may be caused by hysteresis-remaining flexible film 203, can be prevented. Such a configuration can be effectively used for extending the ink near-end condition, which uses ink remaining in the sub-tank 35 in view of air intrusion conditions.

Figure 20:
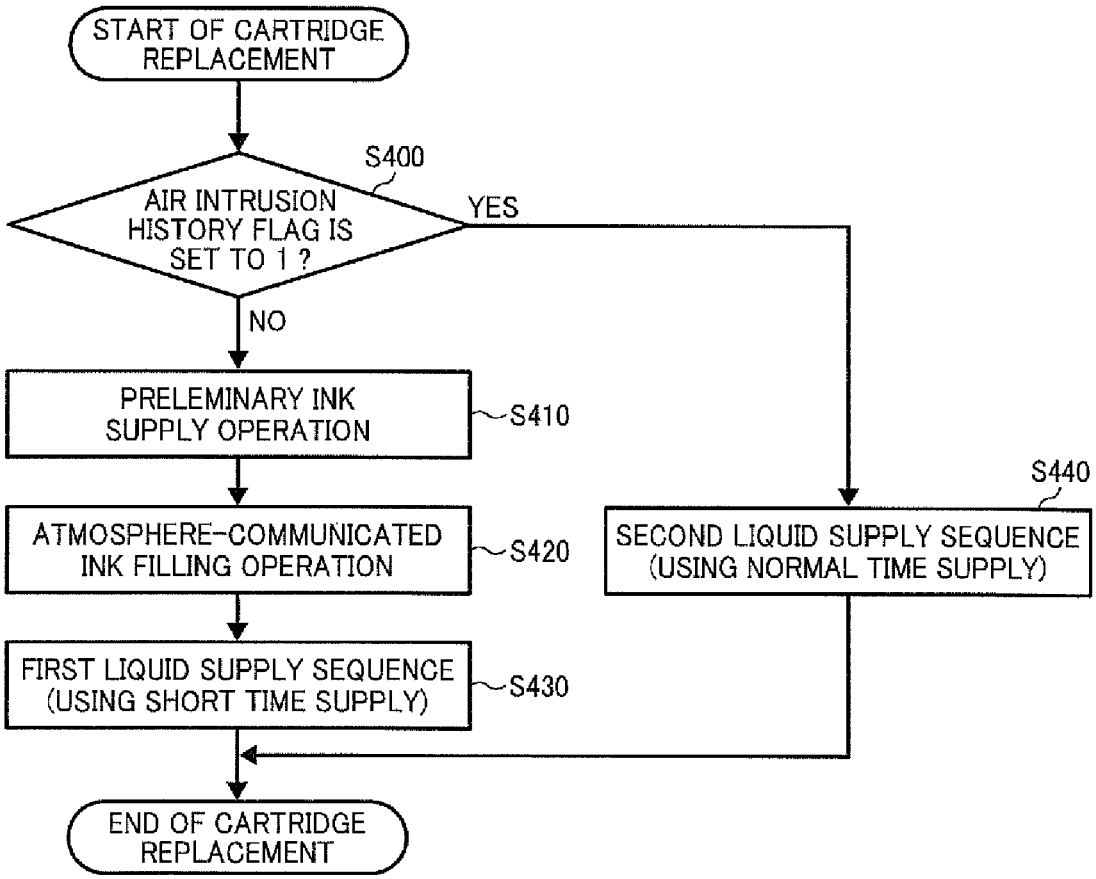
FIG. 20 is a flow chart for another ink supply operation after replacing a cartridge.

FIG. 20 shows a flow chart for ink filling operation using the preliminary ink supply process after replacing the ink cartridge 10 with a new one.

At step S400, it is determined whether the air intrusion history flag=1 is detected. If it is determined that the air intrusion history flag=1 is detected (Yes at step S400), ink is supplied to the sub-tank 35 by employing the second liquid supply sequence (using with normal time supply) without conducting the ink filling operation under the atmosphere-communicated condition at step S440. With such process, operational failures such as ink spillover to the atmosphere-communicable unit 207 or ink detection delay, caused by gas bubble intrusion, can be prevented.

On one hand, if it is determined that the air intrusion history flag=0 is detected (No at step S400), ink is preliminary supplied to the sub-tank 35 for one time with a preliminary volume without conducting the atmosphere-communicating operation at step S410, in which the flexible film 203 can be moved by the preliminary-supplied ink so that hysteresis can be removed from the flexible film 203. At step S420, the ink filling operation under the atmosphere-communicated condition is conducted for the sub-tank 35. With such a configuration, hysteresis of the flexible film 203 can be removed effectively.

At step S430, the first liquid supply sequence (using short time supply) is conducted for the sub-tank 35, by which gas bubble intruded inside the ink supply route can be transported to the sub-tank 35, wherein the gas bubble may intrude in the ink supply route when the ink cartridge 10 is replaced with a new one, for example.

Ink can be supplied to the sub-tank 35 with a given volume per unit time by controlling an ink supply time. Accordingly, the flexible film 203 can be effectively expanded by supplying a given volume of ink controlled by an ink supply time.

Such effective ink supply, controlled by the ink supply time, can be conducted for the preliminary ink supply, the ink supply under the atmosphere-communicated condition, and the liquid supply sequence, as required. Accordingly, the flexible film 203 can restore its shape effectively.

As such, a restoration of inflated shape of the flexible film 203 may be effectively conducted by supplying a given ink volume to the sub-tank 35 controlled by the ink supply time.

Figure 21A:
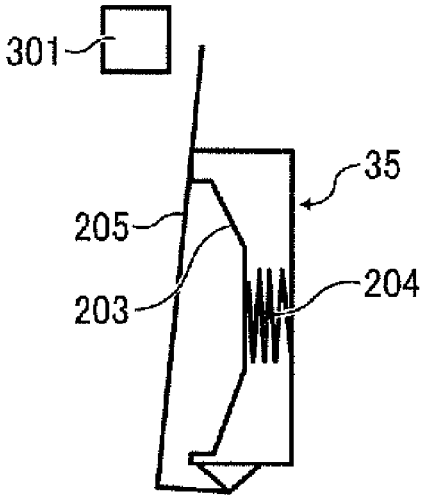
FIG. 21 illustrates a detection process of a displacement member when a flexible film restores its shape.
Figure 21B:
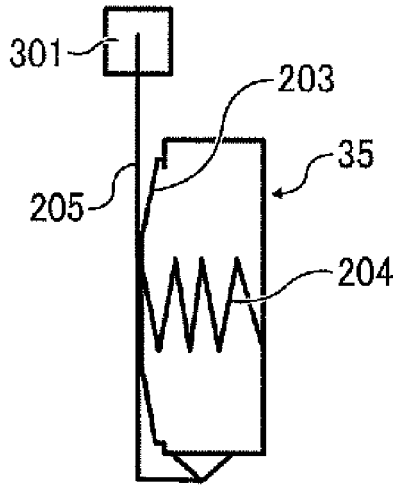

Further, a restoration of inflated shape of the flexible film 203 can be effectively conducted and directly detected using the filler detection sensor 301. Such detection scheme is described with reference to FIGS. 21A and 21B. As shown in FIG. 21A, the sub-tank 35 can be moved to a given position where the displacement member 205 becomes out of the filler detection sensor 301, and then ink is supplied to the sub-tank 35 under such condition. As ink is supplied to the sub-tank 35 under such condition, the flexible film 203 expands to an outward direction, and the displacement member 205 also moves toward the filler detection sensor 301. When the displacement member 205 comes to a position in the filler detection sensor 301 as shown in FIG. 21B, the filler detection sensor 30 can detect the displacement member 205. Then, it is determined that the flexible film 203 restores its inflated shape effectively. As such, a restoration of inflated shape of the flexible film 203 can be directly detected using the filler detection sensor 301.

Further, the internal volume of the ink supply route can be set greater than an ink storage capacity of the sub-tank 35. When the ink cartridge 10 is replaced with a new one, gas bubble may intrude the ink supply system because the supply pump 241 is exposed to atmosphere. However, gas bubble intrusion to the sub-tank 35 can be prevented at least for a given period of time by setting the internal volume of the ink supply route greater than the ink storage capacity of the sub-tank 35. Accordingly, in other words, until an ink supply operation under the atmosphere-communicated condition is conducted for the first time to the sub-tank 35, the sub-tank 35 may be free of gas bubble because ink, which may be free of gas bubble, can be supplied from the ink supply route. With such a configuration, operational failures such as false ink detection or ink spillover to the atmosphere-communicable unit 207, caused by intruded gas bubble, can be prevented.

The above-described process for determining ink end condition using the dispensable ink volume of sub-tank 35, variably set depending on values of the air intrusion history flag, can be executed using a computer-readable program stored in a memory (e.g., non-volatile memory 514). Further, such computer-readable program can be downloaded and installed to an information processing apparatus such as the image forming apparatus 1 from a network (e.g., the Internet, local area network).

Further, the image forming apparatus 1 may be a printer, a multifunctional apparatus having printer/facsimile/copier function, but not limited these.

In the above-described example embodiments, the sub-tank having the flexible member and the elastic member can be effectively employed for extending a period of the ink near-end condition while preventing operational failures caused by hysteresis of the flexible member.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a recording head to dispense ink droplets;

a sub-tank to store ink to be supplied to the recording head, the sub-tank including:

an ink storage container for storing ink having an opening at one side of the ink storage container;

a flexible member to seal the opening of the ink storage container, the flexible member being movable in response to ink condition in the ink storage container;

an elastic member to bias the flexible member outward from the ink storage container, a combination of the flexible member and the elastic member being used as a negative pressure generator; and an atmosphere-communicable unit, disposed to the ink storage container, the atmosphere-communicable unit being settable to an open condition and a closed condition, the atmosphere-communicable unit being set to the open condition to communicate an internal space of the ink storage container to atmosphere;

a main tank detachably mounted to the image forming apparatus, the main tank storing ink to be supplied to the sub-tank;

a supply unit to supply ink from the main tank to the sub-tank;

a memory to store data related to an image forming operation; and a controller to control an ink dispensing operation depending on image forming conditions, the controller being configured to determine whether a gas bubble intrudes into the sub-tank, set a gas history flag to a first value in a case that the controller determines that the gas bubble intrudes in the sub-tank, and set the gas history flag to a second value in a case that the controller determines that the gas bubble does not exist in the sub-tank, and store the gas history flag to the memory, wherein in a case that the controller determines that the main tank no longer contains ink and that ink supply from the main tank to the sub-tank is unable to be continued, and in a case that the gas history flag is set to the first value and is stored in the memory, the controller (a) sets a value for a dispensable ink volume, which is a threshold ink volume that is permitted to be dispensed from the sub-tank, to a first volume, the first volume being smaller than a second volume set in a case that the gas history flag is set to the second value, and (b) executes the ink dispensing operation from the recording head using ink remaining in the sub-tank, while prohibiting an atmosphere-communicating operation performed by the atmosphere-communicable unit.

2. The image forming apparatus according to claim 1, wherein, when it is determined that a given time elapses after replacing the main tank with a new main tank, the gas history flag stored in the memory is changed from the first value to the second value.

3. The image forming apparatus according to claim 1, wherein when the gas history flag stored in the memory is set to the second value, an atmosphere-communicating operation by activating the atmosphere-communicable unit is allowable, wherein when the main tank is replaced with a new main tank, ink is supplied from the main tank to the sub-tank for one time while the atmosphere-communicating operation is activated by the atmosphere-communicable unit, in which the internal space of the sub-tank is communicated to atmosphere.

4. The image forming apparatus according to claim 3, wherein, after replacing the main tank with the new main tank, ink corresponding to an internal volume of a supply route extending from the main tank to the sub-tank is supplied to the sub-tank.

5. The image forming apparatus according to claim 1, wherein, when the gas history flag stored in the memory is set to the second value, ink is supplied to the sub-tank after replacing the main tank with a new main tank by supplying ink preliminary to the sub-tank with a preliminary ink volume without communicating the internal space of the sub-tank to atmosphere, and subsequently supplying ink from the main tank to the sub-tank by communicating the internal space of the sub-tank to atmosphere by activating the atmosphere-communicable unit.

6. The image forming apparatus according to claim 5, wherein the controller varies a length of ink supply time for the sub-tank when ink is supplied to the sub-tank.

7. The image forming apparatus according to claim 6, wherein the preliminary ink volume, supplied to the sub-tank by controlling the length of ink supply time, moves the flexible member outward from the sub-tank.

8. The image forming apparatus according to claim 6, further comprising:

a position detector to detect a position of the flexible member, the flexible member being movable in a given direction as ink is supplied to the sub-tank from the main tank, wherein the sub-tank is determined to have entered an ink-filled condition when the position detector detects that the flexible member arrives at a given position.

9. The image forming apparatus according to claim 5, wherein an internal volume of the supply route extending from the main tank to the sub-tank is greater than an ink storage capacity of the ink storage container of the sub-tank.

10. An ink dispensing operation control method for an image forming apparatus, the image forming apparatus comprising: a recording head to dispense ink droplets; a sub-tank to store ink to be supplied to the recording head; a main tank detachably mounted to the image forming apparatus, the main tank storing ink to be supplied to the sub-tank; a supply unit to supply ink from the main tank to the sub-tank; a memory to store data related to an image forming operation; and a controller to control an ink dispensing operation depending on image forming conditions, the sub-tank including an atmosphere-communicable unit being settable to an open condition and a closed condition, the atmosphere-communicable unit being set to the open condition to communicate an internal space of the sub tank to atmosphere, the control method comprising the steps of:

determining whether a gas bubble intrudes into the sub-tank;

setting a first gas history flag in a case that it is determined that the gas bubble intrudes in the sub-tank and storing the first gas history flag to the memory;

setting a second gas history flag in a case that it is determined that the gas bubble does not exist in the sub-tank and storing the second gas history flag to the memory;

variably setting a first dispensable ink volume for the first gas history flag and a second dispensable ink volume for the second gas history flag, and the first dispensable ink is smaller than the second dispensable ink volume; and executing with the controller the ink dispensing operation from the recording head using ink remaining in the sub-tank, while setting a dispensable ink volume to the first dispensable ink volume and while prohibiting an atmosphere-communicating operation by the atmosphere communicable unit, when an ink supply from the main tank to the sub-tank is unable to be continued and when the first gas history flag is set.

11. The image forming apparatus according to claim 1, wherein the first volume is selected such that in a case that the first volume is dispensed from the sub-tank, the flexible member is not caused to enter a state of hysteresis, and the second volume is selected such that in a case that the second volume is dispensed from the sub-tank, the flexible member is caused to enter a state of hysteresis.

12. The image forming apparatus according to claim 11, wherein in a case that the gas history flag is set to the first value and the dispensable ink volume is set to the first volume, an image forming operation is stopped after the first volume is dispensed from the sub-tank, to thereby prevent hysteresis in the flexible member until the main tank is replaced, and the sub-tank is thereafter refilled with ink from the main-tank, while the atmosphere-communicable unit is set to the closed position.

13. The image forming apparatus according to claim 11, wherein in a case that the gas history flag is set to the second value and the dispensable ink volume is set to the second volume, an image forming operation is stopped after the second volume is dispensed from the sub-tank, until the main tank is replaced, and the sub-tank is thereafter refilled with ink from the main-tank, while the atmosphere-communicable unit is set to the open position to rectify hysteresis in the flexible member.

14. An image forming apparatus, comprising:

a recording head to dispense ink droplets;

a sub-tank to store ink to be supplied to the recording head;

a main tank storing ink to be supplied to the sub-tank;

a supply unit to supply ink from the main tank to the sub-tank; and a controller configured to determine whether a gas bubble intrudes into the sub-tank, and set a gas history flag to a first value, in a case that it is determined that the gas bubble probably intrudes in the sub-tank, and set the gas history flag to a second value, in a case that it is determined that the gas bubble does not exist in the sub-tank, wherein in a case that the controller determines that the main tank no longer contains ink and that ink supply from the main tank to the sub-tank is unable to be continued, and in a case that the gas history flag is set to the first value, the controller (a) sets a value for a dispensable ink volume, which is a threshold ink volume that is permitted to be dispensed from the sub-tank, to a first volume, the first volume being smaller than a second volume set in a case that the gas history flag is set to the second value, and (b) executes the ink dispensing operation from the recording head using ink remaining in the sub-tank, while prohibiting an atmosphere-communicating operation performed by an atmosphere-communicable unit of the sub-tank.

15. The image forming apparatus according to claim 14, wherein the controller determines that the main tank no longer contains ink by determining that both (i) a given time period has elapsed from when the supply unit is activated to supply ink from the main tank to the sub-tank and (ii) the sub-tank has not been filled with ink.

16. The image forming apparatus according to claim 14, wherein the controller determines that an ink end condition occurs when the recording head dispenses the dispensable ink volume set in (a) from the sub-tank, and when the ink end condition is determined, the main tank is replaced with a new main tank.

* * * * *